US011555283B2

(12) United States Patent
Niemela et al.

(10) Patent No.: US 11,555,283 B2
(45) Date of Patent: Jan. 17, 2023

(54) WING PLOW APPARATUS FOR VEHICLE

(71) Applicants: Cal G. Niemela, Chassell, MI (US); Philip J. Quenzi, Atlantic Mine, MI (US)

(72) Inventors: Cal G. Niemela, Chassell, MI (US); Philip J. Quenzi, Atlantic Mine, MI (US)

(73) Assignee: Cal G. Niemela, Chassel, MI (US)

( * ) Notice: Subject to any disclaimer, the term of this patent is extended or adjusted under 35 U.S.C. 154(b) by 306 days.

(21) Appl. No.: 16/869,092

(22) Filed: May 7, 2020

(65) Prior Publication Data

US 2020/0354910 A1 Nov. 12, 2020

Related U.S. Application Data

(60) Provisional application No. 62/844,932, filed on May 8, 2019.

(51) Int. Cl.
*E01H 5/06* (2006.01)

(52) U.S. Cl.
CPC ..... *E01H 5/067* (2013.01); *E01H 5/062* (2013.01); *E01H 5/068* (2013.01)

(58) Field of Classification Search
CPC ..... E01H 5/067; E01H 5/062; E01H 5/068
See application file for complete search history.

(56) References Cited

U.S. PATENT DOCUMENTS

| | | | |
|---|---|---|---|
| 1,552,714 | A | 9/1925 | Linzy |
| 1,594,095 | A | 7/1926 | Fey et al. |
| 2,218,512 | A | 10/1940 | Ball |

(Continued)

FOREIGN PATENT DOCUMENTS

| | | |
|---|---|---|
| CA | 324061 | 7/1932 |
| CA | 629099 | 10/1961 |

(Continued)

OTHER PUBLICATIONS

Boss Products, Boss Snowplow Expanding Wing Drag Pro: Rear Mounted Plow Owner's Manual, copyright 2018, 28 pages, Boss Products, Iron Mountain, Michigan.

(Continued)

*Primary Examiner* — Jamie L McGowan
(74) *Attorney, Agent, or Firm* — Gardner, Linn, Burkhart & Ondersma LLP

(57) ABSTRACT

A snow plow apparatus including at least one pivotable plow wing that is capable of removing snow or debris adjacent to a vehicle. The pivotable plow wing is operable to deploy from a stowed configuration behind the vehicle to a deployed configuration where the plow wing substantially extends beyond a side of the vehicle and is in contact with a surface to be plowed to remove snow adjacent to the footprint of the vehicle. Once deployed, the pivotable wing is configurable to direct snow or debris away from or toward the vehicle by adjusting the angle of the plow wing relative to the direction of travel of the vehicle. The snow plow apparatus includes powered actuators and an electronic control unit that coordinate to operate the snow plow apparatus without the need for an operator to manually deploy, stow, or position the snow plow apparatus.

20 Claims, 30 Drawing Sheets

(56) References Cited

U.S. PATENT DOCUMENTS

| | | | | | |
|---|---|---|---|---|---|
| 2,281,289 | A | | 4/1942 | Hewitt | |
| 2,504,774 | A | | 4/1950 | Williamson | |
| 2,769,254 | A | | 11/1956 | Wright | |
| 2,919,504 | A | | 1/1960 | Rubin | |
| 2,991,566 | A | | 7/1961 | Sumner et al. | |
| 3,061,955 | A | | 11/1962 | Violette | |
| 3,231,991 | A | * | 2/1966 | Wandscheer | E01H 5/065 37/232 |
| 3,233,687 | A | | 2/1966 | Grimes | |
| 3,241,254 | A | | 3/1966 | Ulrich | |
| 3,279,104 | A | * | 10/1966 | Wandscheer | E01H 5/067 37/232 |
| 3,332,159 | A | | 7/1967 | Dunn | |
| 3,429,381 | A | | 2/1969 | Launder et al. | |
| 3,468,042 | A | | 9/1969 | Coy | |
| 3,657,828 | A | * | 4/1972 | Anderson | E01H 5/067 37/274 |
| 3,800,447 | A | * | 4/1974 | Harvey | E01H 5/068 37/236 |
| 3,803,733 | A | | 4/1974 | Ramsey | |
| 3,908,289 | A | * | 9/1975 | Ross | E01H 5/067 37/231 |
| 4,023,287 | A | | 5/1977 | de Brito | |
| 4,073,077 | A | | 2/1978 | Essel et al. | |
| 4,130,952 | A | | 12/1978 | Dion | |
| 4,164,820 | A | | 8/1979 | Krickovich | |
| 4,275,514 | A | | 6/1981 | Maura | |
| 4,369,847 | A | | 1/1983 | Mizunuma | |
| 4,403,432 | A | * | 9/1983 | Biance | E01H 5/068 172/445.2 |
| 4,498,253 | A | | 2/1985 | Schmidt | |
| 4,506,465 | A | * | 3/1985 | Johnson | E01H 5/068 172/799.5 |
| 4,667,426 | A | | 5/1987 | Howard et al. | |
| 4,802,293 | A | * | 2/1989 | Smith | E02F 5/223 37/274 |
| 4,907,357 | A | * | 3/1990 | Lilienthal | E01H 5/068 172/830 |
| 5,046,271 | A | * | 9/1991 | Daniels | E01H 5/068 37/231 |
| 5,050,322 | A | * | 9/1991 | Burkard | E01H 5/068 37/270 |
| 5,058,295 | A | * | 10/1991 | Holland | E01H 5/068 37/236 |
| 5,209,307 | A | * | 5/1993 | Hotte | E01C 19/203 37/231 |
| 5,228,734 | A | | 7/1993 | Pollastro | |
| 5,265,355 | A | * | 11/1993 | Daniels | E01H 5/068 37/234 |
| 5,392,538 | A | * | 2/1995 | Geerligs | E01H 5/068 37/236 |
| 5,410,824 | A | | 5/1995 | Pedersen | |
| 5,450,910 | A | | 9/1995 | Strzyzewski | |
| 5,493,797 | A | | 2/1996 | Jackson | |
| 5,524,555 | A | | 6/1996 | Fanuzzi | |
| 5,595,007 | A | * | 1/1997 | Biance | E01H 5/068 172/445.2 |
| 5,930,922 | A | * | 8/1999 | Altheide | E01H 5/068 37/231 |
| 6,151,809 | A | * | 11/2000 | Altheide | E01H 5/063 37/231 |
| 6,154,985 | A | | 12/2000 | Champagne et al. | |
| 6,163,987 | A | | 12/2000 | Schommer | |
| 6,247,254 | B1 | | 6/2001 | Wessman | |
| 6,408,548 | B1 | * | 6/2002 | Altheide | E01H 5/063 37/232 |
| 6,453,582 | B1 | * | 9/2002 | Fulton, III | E01H 5/066 37/270 |
| 6,516,544 | B1 | | 2/2003 | Matisz et al. | |
| 6,516,894 | B1 | | 2/2003 | Newton et al. | |
| 6,877,258 | B2 | * | 4/2005 | Frey | E01H 5/065 37/274 |
| 7,429,158 | B2 | | 9/2008 | McFarland | |
| 7,493,710 | B2 | | 2/2009 | Frey et al. | |
| 7,584,557 | B1 | | 9/2009 | Nistler | |
| 7,681,337 | B2 | | 3/2010 | Watson | |
| 7,686,563 | B2 | | 3/2010 | Frey et al. | |
| 7,730,644 | B2 | | 6/2010 | Frey et al. | |
| 7,874,571 | B2 | | 1/2011 | Frey et al. | |
| 8,096,066 | B2 | | 1/2012 | Gandolfi | |
| 8,528,237 | B1 | | 9/2013 | Bacall | |
| 8,776,406 | B2 | * | 7/2014 | Stephan | E01H 5/065 37/235 |
| 9,555,746 | B2 | * | 1/2017 | Weihl | B60R 11/06 |
| 9,719,227 | B2 | | 8/2017 | Martin et al. | |
| 9,957,679 | B2 | * | 5/2018 | Lovell | E01H 5/068 |
| 10,106,950 | B2 | | 10/2018 | Martin et al. | |
| 10,150,428 | B2 | * | 12/2018 | Weihl | B60R 11/06 |
| 10,865,534 | B2 | | 12/2020 | Martin et al. | |
| 2002/0074758 | A1 | | 6/2002 | Frey | |
| 2002/0095824 | A1 | | 7/2002 | Johnson | |
| 2003/0226289 | A1 | | 12/2003 | Geerligs | |
| 2006/0150443 | A1 | | 7/2006 | Angeletti | |
| 2009/0119954 | A1 | * | 5/2009 | Lemieux | E02F 3/815 37/236 |
| 2009/0223091 | A1 | | 9/2009 | Livingston et al. | |
| 2011/0239491 | A1 | | 10/2011 | Chen | |
| 2012/0279093 | A1 | | 11/2012 | Niemela et al. | |
| 2013/0298429 | A1 | | 11/2013 | Niemela et al. | |
| 2016/0375839 | A1 | * | 12/2016 | Weihl | B60R 11/06 37/231 |
| 2019/0203436 | A1 | | 7/2019 | Martin et al. | |

FOREIGN PATENT DOCUMENTS

| | | |
|---|---|---|
| CA | 671590 | 10/1963 |
| CA | 1161462 | 1/1984 |
| CA | 2090992 | 5/1996 |
| CA | 2581876 | 9/2008 |
| CA | 2598782 | 9/2008 |
| CA | 2638121 | 2/2009 |
| CA | 2673840 | 2/2010 |
| CA | 2862174 | 3/2015 |
| CA | 3023386 | 5/2019 |
| CA | 3025237 | 5/2020 |
| CA | 3036882 | 9/2020 |
| FR | 3084682 | 2/2020 |
| KR | 101567510 | 11/2015 |

OTHER PUBLICATIONS

YouTube Video, Rolling the Rollover Plow Over!: Frink plow, published Mar. 3, 2014, accessed Nov. 11, 2020, https://www.youtube.com/watch?reload=9&v=zBVSsEh1CHQ.

Horst Loader Attachments, HLA Snow: Snow Brochure, identified as printed on Jul. 2018, 36 pages, Horst Loader Attachments, Listowel, Ontario CA.

* cited by examiner

WING PLOW APPARATUS FOR VEHICLE

CROSS REFERENCE TO RELATED APPLICATION

The present application claims priority of U.S. provisional application Ser. No. 62/844,932 filed May 8, 2019, which is hereby incorporated herein by reference in its entirety.

FIELD OF THE INVENTION

The present invention is directed to snow moving equipment, and more particularly, to a wing plow for snow removal that is configured to mount onto a vehicle.

BACKGROUND OF THE INVENTION

Primarily vehicle mounted snow plowing equipment includes snow plows mounted to the front or rear of a vehicle, with limited vertical actuation, and configured to move snow or debris from the forward or rearward travel path of the vehicle. Other types of vehicle mounted snow plowing equipment include pivoting snow plows mounted to a vehicle and configured to move snow or debris adjacent to one side of the travel path of the vehicle. Vehicle mounted snow plowing equipment typically provides snow removal for a width of ground or surface that is substantially the width of the vehicle, or slightly wider than the width of the vehicle. Vehicle mounted snow plowing equipment typically requires an operator of the vehicle to maneuver the vehicle into an ideal position prior to removing the snow or debris from the surface.

SUMMARY OF THE INVENTION

The present invention provides a snow plow apparatus configured to couple to a vehicle, such as a light-duty or medium-duty truck, for clearing snow or debris from a surface adjacent or proximate to the vehicle, such as outboard of the drive path of the vehicle. The snow plow apparatus includes at least one pivotable wing, plate, or plow blade pivotably coupled to the vehicle and configured to pivotably deploy from a stowed configuration to a deployed configuration, wherein the plow blade in the stowed configuration is up and away from the surface to be plowed and in the deployed configuration the plow blade is at least in partial contact with the surface to be plowed. The plow blade is further pivotable between forward-swept and rearward-swept positions relative to the forward direction of travel of the vehicle. The snow plow apparatus is removably coupled to the vehicle so that it can be stored apart from the vehicle. An electronic control system and powered actuators are included to deploy, stow, and position the blades and the snow plow apparatus. Additional features of the snow plow apparatus may include a center snow plow plate or blade, plate position indicators or sensors, accumulators to protect the snow plow apparatus from damage, and "float" functionality allowing the pivotable plow blades to substantially freely raise and lower vertically while maintaining at least partial contact with the surface to be plowed when the plow blades encounter un-even or changing elevations of the surface to be plowed.

According to one form of the present invention, a snow plow apparatus includes a pivotably deployable snow plow wing, plate, or blade pivotably coupled to a vehicle and configured to clear snow or debris proximate the vehicle. The snow plow apparatus includes a support frame having at least one vehicle frame attachment member configured to couple the support frame to a portion of the vehicle frame. Optionally, the snow plow apparatus is configured to couple to a portion of the vehicle frame at the rear of the vehicle. The vehicle frame attachment member is configured to removably couple the snow plow apparatus to the vehicle such that the snow plow apparatus can be removed and stored apart from the vehicle. Optionally, a vehicle hitch receiver mount is included to removably couple the snow plow apparatus to the hitch receiver of the vehicle.

In one aspect, the deployable plow wing is pivotable about a pivot or hinge disposed on the support frame. The pivot or hinge defines a longitudinal pivot axis defined by an axis substantially parallel to the forward-rearward direction of travel of the vehicle. Once the plow wing is pivoted to the deployed configuration, it extends at least a majority of the length of the plow wing blade beyond a side of the vehicle to clear snow or debris that is adjacent to the vehicle and the vehicle drive path. The deployed configuration occurs when the plow wing is in at least partial contact with the surface to be plowed. The stowed configuration occurs when the plow wing is substantially vertically above the support frame and substantially within an envelope defined by the width of the vehicle. Optionally, the plow wing is positionable at increments between the fully deployed and the fully stowed configurations.

The plow wing is further pivotable about a sweep axis, such that after the deployable plow wing is deployed about the longitudinal axis the wing is movable between forward-swept and rearward-swept positions about an arc that is substantially parallel to the surface to be plowed. The sweep axis is defined by an axis that is substantially perpendicular to the longitudinal axis and is substantially vertical of the longitudinal axis when the plow wing is in the deployed configuration. The plow wing is positionable at increments between the forward-swept position wherein the plow wing defines an acute angle between the wing and the side of the vehicle and the fully rearward-swept position wherein the plow wing is substantially parallel to the direction of travel of the vehicle. A neutral position of the plow wing is defined by a substantially perpendicular orientation between the plow wing and the forward direction of travel of the vehicle, with the plow wing oriented generally horizontal or parallel to the surface to be cleared. During typical operation, the plow wing is positioned in a normal operation position that is swept about 30° rearward of the neutral position.

In another form of the present invention, the snow plow apparatus includes a plurality or the deployable snow plow wings such that one of the plurality of plow wings, a right side plow wing, is pivotably coupled to a right side portion of the support frame and another one of the plurality of plow wings, a left side plow wing, is pivotably coupled to a left side portion of the support frame, wherein the right and left sides of the support frame correspond to right and left sides of the vehicle when viewing the vehicle from the rear of the vehicle. The right side and left side plow wings are each independently pivotable about a pivot or hinge disposed on respective sides of the support frame. The pivots or hinges define a longitudinal pivot axis defined by an axis substantially parallel to the forward-rearward direction of travel of the vehicle. Once the plow wings are pivoted or deployed, they extend at least a majority of the length of the plow wing blade beyond the respective side of the vehicle to clear snow or debris that is adjacent to the vehicle, such as to an outboard side of the drive path of the vehicle. The deployed configuration occurs when the plow wings are in at least partial contact with the surface to be plowed. The stowed configuration occurs when the plow wings are substantially vertically above the support frame and substantially within an envelope defined by the width of the vehicle. Optionally, the plow wings are positionable at increments between the fully deployed and the fully stowed configurations.

After the right side and left side plow wings are deployed about the longitudinal axis, the right side and left side plow wings are further pivotable about a sweep axis. The sweep axis is defined by an axis that is substantially perpendicular to the longitudinal axis and is substantially vertical when the plow wings are in the deployed configuration. The plow wings are positionable at increments between a forward position wherein the plow wings define an acute angle between each wing and the side of the vehicle and a fully rearward position wherein the plow wings are substantially parallel to the direction of travel of the vehicle. A neutral position of the plow wings is defined by a substantially perpendicular orientation between the plow wing and the forward direction of travel of the vehicle.

In another aspect, a center plow blade or plate is pivotably coupled to a bottom portion of the support frame and configured to clear snow or debris from a surface to be plowed that is below the support frame, substantially within the footprint of the vehicle. The center blade is in a stowed configuration when center plate is above the ground or surface to be plowed. In one embodiment, the stowed configuration is defined when the center blade is flipped up and backward relative to the support frame such that the center blade is not in contact with the surface to be plowed. The deployed configuration is defined when the center blade is flipped down such that the center blade is in contact with the surface to be plowed.

In yet another aspect, a powered actuator is coupled between the plow wing and the support frame to operably actuate the plow wing about the longitudinal axis between the stowed configuration and the deployed configuration, as well as increments between the fully stowed configuration and the fully deployed configuration. In another aspect, a powered actuator is coupled between each plow wing and the support frame to operably actuate or sweep the plow wing about the sweep axis between a fully forward-swept and a fully rearward-swept position, as well as increments between the fully forward-swept and fully rearward-swept position, such as the neutral position. Optionally, a powered actuator is coupled between the optional center blade and the support frame to deploy and stow the pivotable center blade. The powered actuators may include fluid power cylinders such as hydraulic cylinders.

In still another aspect, the snow plow apparatus includes an electronic control unit configured to control the stowage, deployment, and positioning of the snow plow apparatus, including the plow wing(s) and optional center blade. The electronic control unit is configured to communicate with the powered actuators to position, deploy, stow, actuate, and/or sweep the plow wing about the longitudinal axis and the sweep axis, respectively. Preferably, the electronic control unit includes a remote control in communication with the electronic control unit such that an operator can operate the electronic control unit from a location apart from the snow plow apparatus, such as inside a cab of a vehicle. Optionally, the remote control is in wireless communication with the electronic control unit. The remote control is configurable to independently operate different functions of the plow wing(s) and the optional center blade of the snow plow apparatus.

In still another aspect, the plow wing includes an accumulator configured to absorb impact forces experienced when the plow wing impacts a heavy or fixed object, such that damage to the snow plow apparatus is minimized, reduced, or avoided. The accumulator is configurable to couple with the hydraulic actuator of the plow wing such that the accumulator and the actuator coordinate to reduce or eliminate damage to the snow plow apparatus and vehicle. The accumulator is configured to allow the plow wing to "break away" or swing open in response to the impact force without transferring at least a portion of the impact force to the snow plow apparatus. Optionally, the accumulator in coordination with the actuator of the plow wing is operable to return the plow wing to the set position it occupied prior to the impact event causing the break away.

In yet another aspect, the optional center blade includes an impact trip or release configured to trip or release the center blade from the deployed position in response to an impact with a heavy or fixed object. The impact trip or release is configured to reduce or eliminate damage to the snow plow apparatus from unexpected forces due to impact with heavy or fixed objects. Once the center blade is tripped or released it remains in the stowed position until the operator re-deploys the center blade. Optionally, the center blade impact trip includes an accumulator configured to absorb impact forces experienced when the center blade impacts a heavy or fixed object. The accumulator is configurable to allow the center blade to return to the deployed position after tripping or releasing.

In a further aspect, the snow plow apparatus include a blade or plate position or location indicator, such as an electronic sensor, disposed proximate to the plow wings to communicate position, location, or sweep information of the plow wings to the electronic control unit or to an operator. The blade position sensors can be disposed with or proximate to the sweep pivot axis. Optionally, the blade position sensors include contactless or optical sensors.

Optionally, the snow plow apparatus includes a plurality of support elements, such as struts or jack stands disposed at a plurality of locations on the support frame that are configured to support the snow plow apparatus on the ground or a surface below the snow plow apparatus. The jack stands provide support to the snow plow apparatus when it is detached or removed from the vehicle, such as for storage. The jack stands provide assistance to the operator for attaching and detaching the snow plow apparatus to the vehicle. Optionally, the jack stands are pivotably coupled to the support frame such that they are pivotably stowable while the snow plow apparatus is coupled to the vehicle and are pivotably deployable for attachment, detachment, and storage of the snow plow apparatus.

Therefore, the snow plow apparatus of the present invention provides a one or a plurality of deployable snow plow plates or blades configured to couple to a vehicle to remove snow or debris from the ground or surface proximate the vehicle. The snow plow apparatus is deployable to remove snow that is adjacent to the vehicle and is configurable to remove snow on either or both sides of the vehicle, and optionally snow that is directly behind the vehicle, while in varying degrees of deployment. In a stowed configuration, the snow plow apparatus is substantially within the space defined by the width of the vehicle to decrease the possibility of collisions between the snow plow apparatus and objects or obstacles adjacent to the vehicle while the vehicle is in motion. The stowed configuration allows the snow plow apparatus to be stowed or stored in a compact configuration apart from the vehicle. Powered actuators and an electronic control system allow an operator to deploy, stow, and position the snow plow apparatus from a remote location, such as in a cab of the vehicle.

These and other objects, advantages, purposes, and features of the present invention will become more apparent upon review of the following specification in conjunction with the drawings.

DESCRIPTION OF THE PREFERRED EMBODIMENTS

Figure 1:
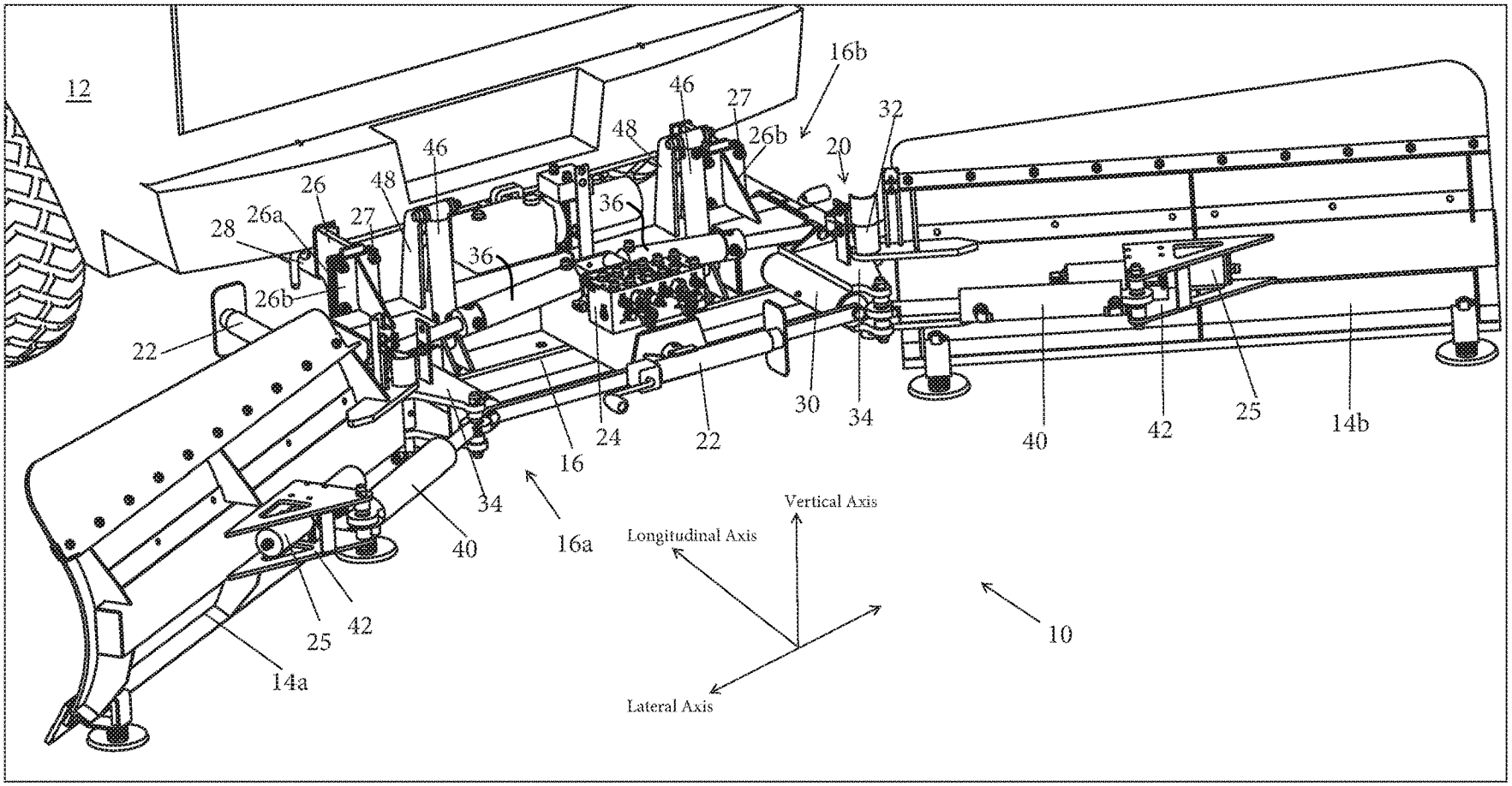
FIG. 1 is a rear perspective view of a vehicle mounted wing plow system in accordance with the present invention, with plow wings deployed.
Figure 2A:
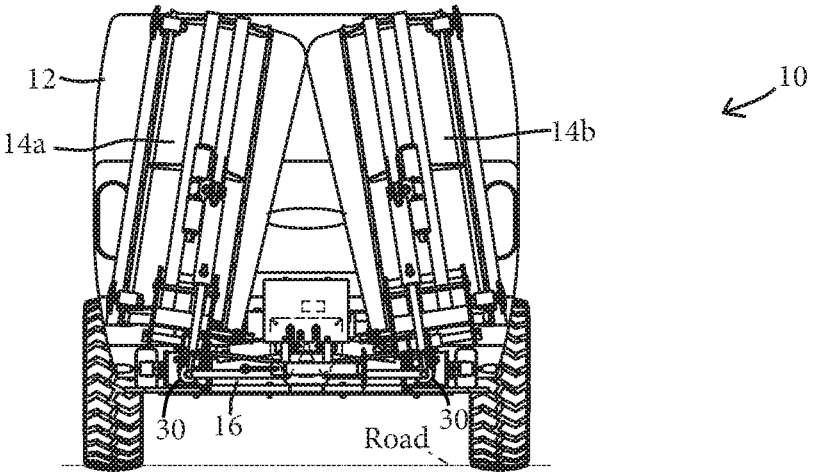
FIG. 2A-2E are rear elevation views of the system of FIG. 1, depicting sequential steps of moving the plow wings from a stowed configuration to a deployed configuration.
Figure 2B:
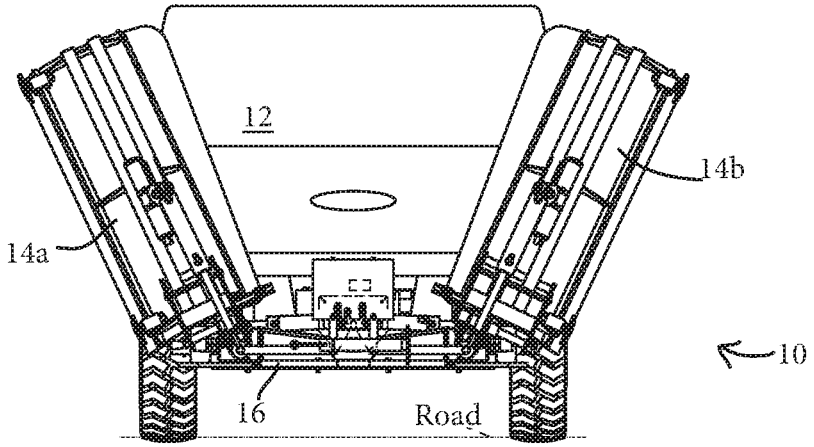
Figure 2C:
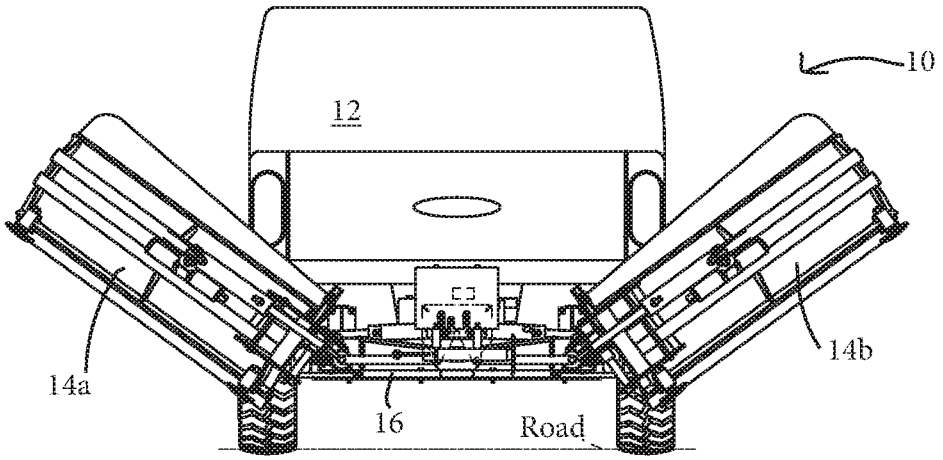
Figure 2D:
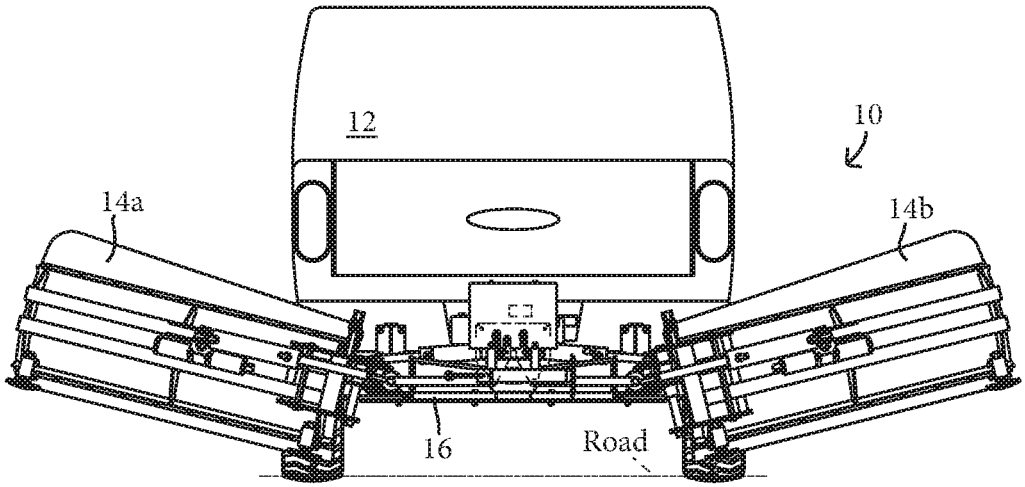
Figure 2E:
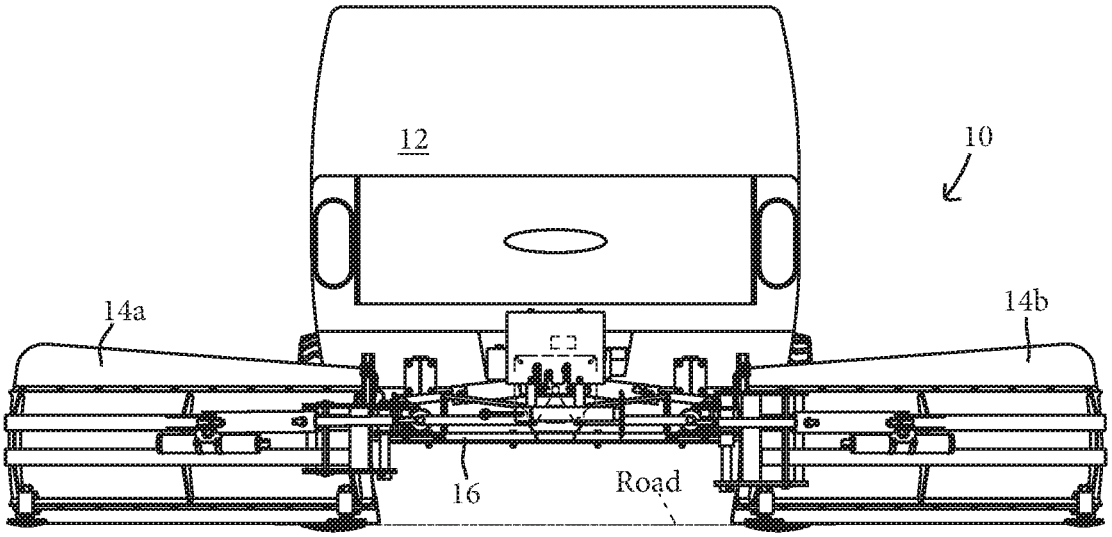
Figure 3A:
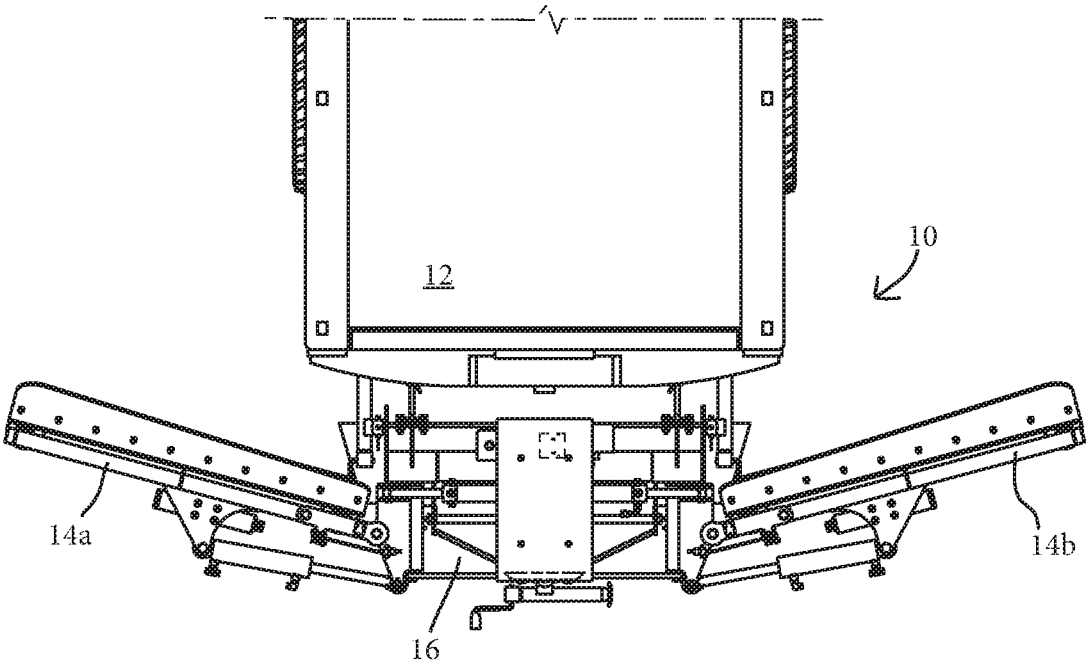
FIG. 3A-3D are top plan views of the system of FIG. 1, depicting sequential steps of moving the plow wings from a partially forward-swept configuration to a fully rearward-swept configuration.
Figure 3B:
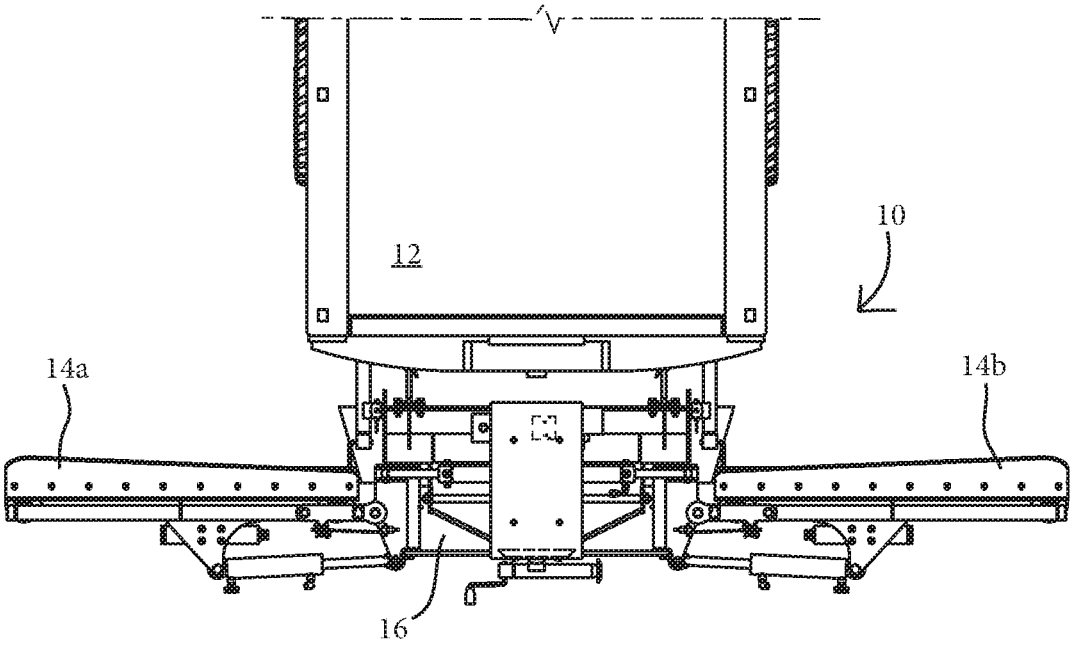
Figure 3C:
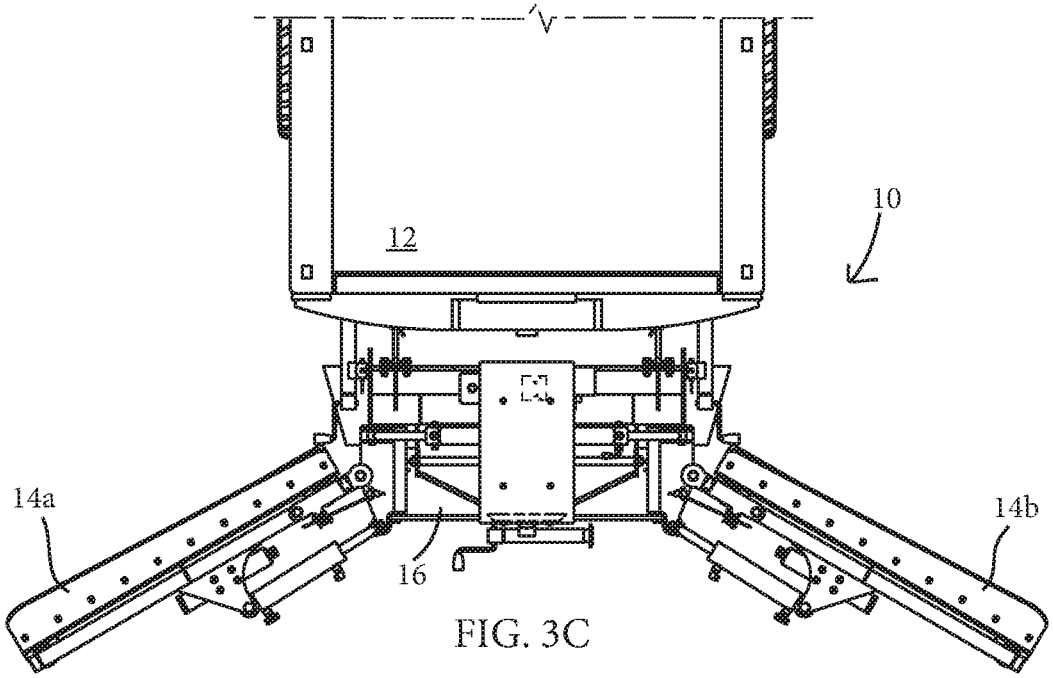
Figure 3D:
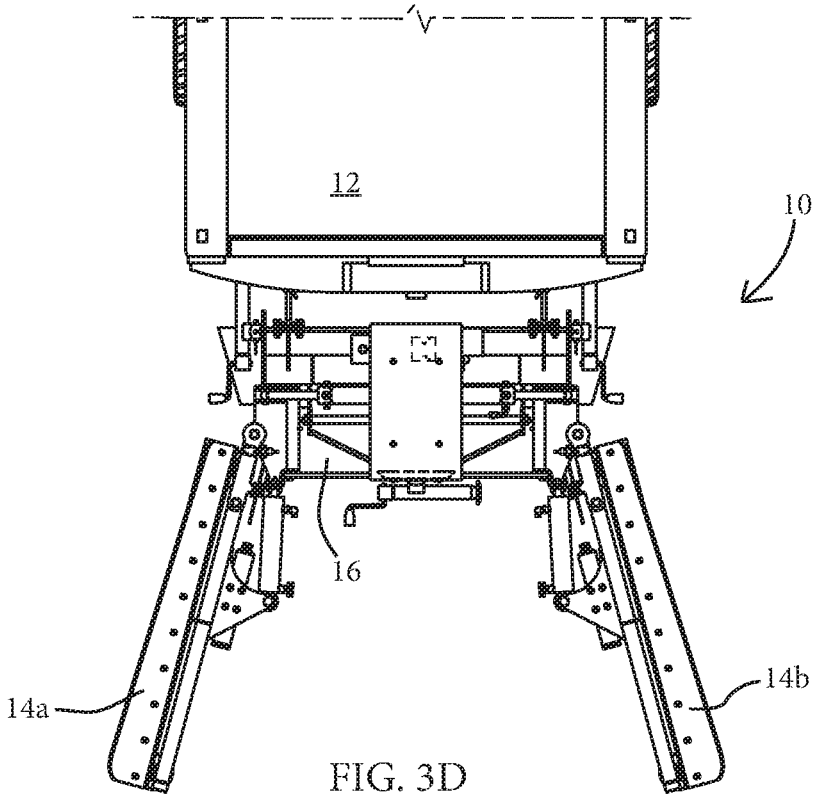
Figure 4:
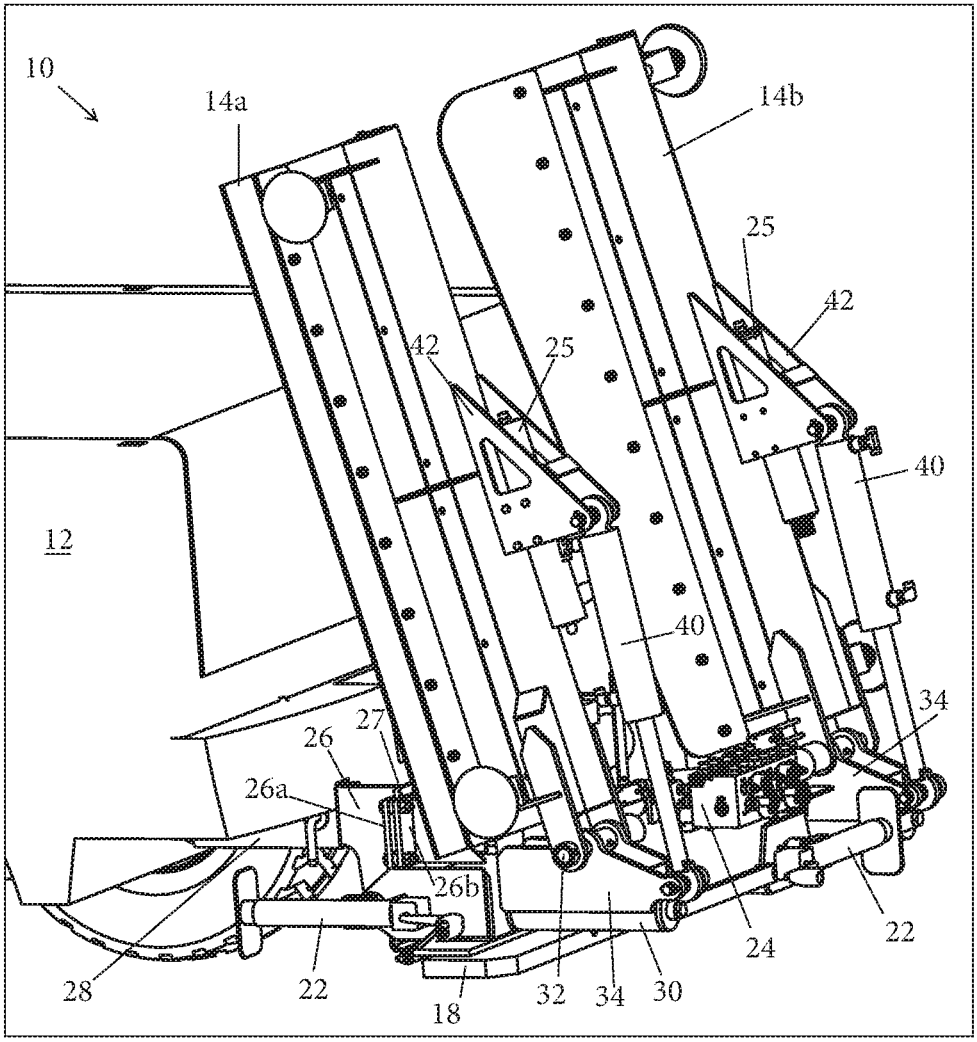
FIG. 4 is another rear perspective view of the system of FIG. 1, shown with the plow wings stowed.

Referring now to the drawings and the illustrative embodiments depicted therein, a snow plow apparatus 10 is configured to mount to a vehicle 12 and includes at least one independently pivotable plow wing, plow, plate, or blade 14*a*, 14*b* (FIG. 1). Each plow wing 14*a*, 14*b* is configured to clear or remove snow, ice, debris, or other foreign objects from a surface to be plowed proximate the vehicle 12, such as to an outboard side of the vehicle or its drive path. In the illustrated embodiment, each plow wing 14*a*, 14*b* is coupled to a support frame 16 that removably mounts or couples to the vehicle 12, such as shown in FIGS. 1-4. The deployable plates 14*a*, 14*b* are stowable for transport such that the plates are substantially stowed within an envelope defined by the width of the vehicle 12 body as viewed from the rear of the vehicle 12 (FIG. 4). In a stowed configuration, the plow wings 14*a*, 14*b* have limited or no forward exposure to interaction with objects or obstacles adjacent the vehicle 12 when the vehicle 12 is travelling forward, that would pose potential striking hazards for the snow plow apparatus 10 in a deployed configuration, but would otherwise not be obstacles for the vehicle 12 alone. Examples of such striking hazard include oncoming traffic, street signs, mailboxes, and animals. Optionally, the snow plow apparatus includes a center pivotable plow, plate, or blade 18 (FIGS. 4-6 and 8A-9B) disposed below the support frame 16 and configured to clear or remove snow, ice, debris, or other foreign objects from the surface to be plowed that are located below the support frame 16 and inaccessible to the pivotable wings 14*a*, 14*b*. Optional features include a "float" function, plate position indicators such as electronic sensors 20, jack stands 22, a controller and circuit 24 to operate the snow plow apparatus 10, and damage protection features such as accumulators 25, which will be described below in more detail.

The support frame 16 supports each of the plates 14*a*, 14*b*, and 18 and respective actuators coupled to each plate, and provides a link or connection frame 16 between the vehicle 12 and the plow wings 14*a*, 14*b* and 18. The support frame 16 includes a pair of vehicle frame mounts 26 configured to removably couple to a portion of the vehicle frame 28 to secure the snow plow apparatus 10 to the vehicle 12. Optionally, the support frame 16 includes a vehicle hitch receiver mount (not shown) configured to removably couple the snow plow apparatus 10 to the vehicle 12. The vehicle hitch receiver mount may be utilized individually or in cooperation with the vehicle frame mounts 26 to secure the snow plow apparatus 10 to the vehicle 12. Optionally, the support frame 26 includes an auxiliary hitch receiver (not shown) to receive a hitch of an auxiliary implement, such as a trailer.

In the illustrated embodiment of FIGS. 1-11, the support frame 16 is removably coupled to the vehicle frame mounts 26. The vehicle frame mounts 26 are fixedly attached to the vehicle frame 28 and include a support frame receiving element 26*a* to removably attach to a support frame attachment element 26*b* that is fixedly coupled to the support frame 16, to removably couple the snow plow apparatus 10 to the vehicle 12, such as shown in FIGS. 4 and 8A-9B. The vehicle frame mounts 26 are adaptable to fit many configurations and sizes of vehicle frames 28 and to receive the support frame attachment element 26*b*. The support frame receiving element 26*a* and support frame attachment element 26*b* may be removably coupled together with mechanical fasteners 27, such as bolts and nuts.

Each plow wing 14*a*, 14*b* is pivotably coupled with the support frame 16 at a respective outboard portion 16*a*, 16*b* of the support frame 16 (FIG. 1). Each plow wing 14*a*, 14*b* is independently pivotably coupled with the support frame 16, such that either wing 14*a* or 14*b* is pivotable regardless of whether the other plate is pivoting, sweeping, or moving. Each wing 14*a*, 14*b* is laterally pivotable about a longitudinal axis substantially parallel to the forward-rearward direction of travel of the vehicle 12. A longitudinal hinge or pivot 30 is disposed and coupled between a proximal or inboard end of each wing 14*a*, 14*b* and a respective outboard portion 16*a*, 16*b* of the support frame 16. As illustrated in FIGS. 2A-2E, each wing 14*a*, 14*b* is operable to move about its respective pivot 30 (labeled only in FIG. 2A) such that a distal or outboard end of each wing 14*a*, 14*b* is movable through an arc defined in a plane that is substantially perpendicular to the longitudinal axis and the direction of travel of the vehicle 12. Each wing 14*a*, 14*b* is further pivotable about a sweep axis to sweep, pivot, or rotate the wing 14*a*, 14*b* about the sweep axis, wherein the sweep axis is substantially perpendicular to the longitudinal axis and substantially vertical relative to the longitudinal axis when the wing 14*a*, 14*b* is in the deployed configuration. A sweep hinge or pivot 32 is disposed between a proximal end of each wing 14*a*, 14*b* and a respective longitudinal pivot frame or bracket 34, wherein the longitudinal pivot bracket 34 is coupled to a respective longitudinal pivot 30 (FIGS. 1 and 4). As illustrated in FIGS. 3A-3D, each wing 14*a*, 14*b* is operable to move or sweep about the respective sweep pivot 32, when in the deployed configuration, such that the distal end of each wing 14*a*, 14*b* is movable through an arc defined in a plane that is substantially parallel to the surface to be plowed.

In the illustrated embodiment, a powered deployment actuator 36 is provided for each plow wing 14*a*, 14*b*. Each actuator 36 is operably coupled at one end to a respective pivot bracket 34 and at an opposite end to the support frame 16 to actuate, deploy, stow, or pivot the respective plow wing 14*a*, 14*b* about its longitudinal pivot 30. The deployment actuator 36 is selectively and independently operable to actuate the wing 14*a*, 14*b* from the stowed configuration of FIGS. 2A, 4, and 5 to the deployed configuration of FIGS. 2E, 3A-3D, 6, 7, and 10, and to support the wing 14*a*, 14*b* at intervals between the deployed and stowed configurations. From the stowed configuration, as the deployment actuator 36 extends, the actuator 36 urges the pivot bracket 34 away from the inboard end of the deployment actuator 36. As the pivot bracket 34 is urged further from the deployment actuator 36 the plow wing 14*a*, 14*b* pivots about the longitudinal pivot 30 outward and away from the center line of the support frame 16, and then downward toward the surface to be plowed. From the deployed configuration, as the deployment actuator 36 retracts, the actuator 36 pulls the pivot bracket 34 toward the actuator 36, as the pivot bracket 34 is pulled closer to the actuator 36 the plow wing 14*a*, 14*b* pivots about the longitudinal pivot 30 upward away from the surface to be plowed and then inward and toward the center line of the support frame 16. The deployment actuator 36 is configured to absorb at least a portion of an impact force from an object or obstacle striking or colliding with the wings 14*a*, 14*b* such that damage to the wing 14*a*, 14*b*, the actuator 36, or the support frame 16 can be avoided, or at least reduced or minimized. The deployment actuator 36 may utilize a motor such as a linear motor, a motorized compressor, or the like to drive the actuator 36. Preferably, the deployment actuator 36 is a fluid powered cylinder such as a hydraulic cylinder.

In the illustrated embodiment, and as best shown in FIGS. 1 and 4-7, a powered sweep actuation mechanism, defined as an extendable actuator 40, is operably coupled at one end to a portion of a respective pivot bracket 34 and at an opposite end to a respective actuation bracket 42, disposed at a middle region of each of the plow wings 14*a*, 14*b*. The sweep actuator 40 is provided to actuate or pivot the respective plow wing 14*a*, 14*b* about its sweep pivot 32 between a fully forward-swept position that is at an angle forward of perpendicular with respect to the direction of travel of the vehicle 12 (FIG. 3A) and a fully rearward-swept position that is typically at or beyond 60° rearward of perpendicular with respect to the direction of travel (FIG. 3D). Preferably, the fully rearward-swept position is angled sufficiently so that the plow wing 14*a* or 14*b* is fully within the lateral width of the vehicle to which it is mounted. Therefore, depending on the vehicle location where the plow wing is mounted, and the width of the vehicle, a greater or lesser maximum rearward sweep angle may be sufficient to position the wing fully within the width of the vehicle (i.e., between the outboard edges of the tires on either side of the vehicle). While the fully rearward-swept position shown in FIG. 3D is at about 80° rearward of perpendicular with respect to the direction of travel (i.e., about 10° offset from being in-line with the vehicle's longitudinal axis), the fully rearward-swept position may typically be at any angle beyond 60° rearward of perpendicular with respect to the direction of travel, such as substantially parallel to the direction of travel of the vehicle 12 (i.e. 90° rearward of perpendicular with respect to the direction of travel).

The plow wings 14*a*, 14*b* may be moved to the fully rearward-swept position by the sweep actuator 40, or due to impact of either wing with an object that forces the wing to pivot or sweep rearwardly against the biasing force of the sweep actuator, as will be described in more detail below. In the case of such an impact, the sweep actuator 40 would automatically return the wing forwardly to its selected sweep position once the object has been cleared. Because the wings 14*a*, 14*b* can be fully within the lateral width of the vehicle, the fully rearward-swept position of the wings 14*a*, 14*b* can be used to drive the vehicle through narrow spaces while still keeping the wings in contact with the surface to be plowed.

The sweep actuator 40 is selectively and independently operable to position the plow wing 14*a*, 14*b* at intervals between the fully forward position and the fully rearward-swept position, such as a neutral sweep position that is substantially perpendicular to the direction of travel of the vehicle (and substantially horizontal or parallel to the surface to be cleared), and a normal or partially rearward swept position (such as about 30° rearward of the neutral position). From the deployed configuration in which the plow wing 14*a,* 14*b* is at least partially in contact with the surface to be plowed, the sweep actuator 40 is operable to actuate the wing 14*a,* 14*b,* such that when the sweep actuator 40 extends, the actuator 40 urges the actuation bracket 42 away from the pivot bracket 34. As the actuation bracket 42 is urged further from the pivot bracket 34, the plow wing 14*a,* 14*b* pivots about the sweep pivot 32 forward and toward the vehicle 12. When the sweep actuator 40 retracts, the actuator 40 urges the actuation bracket 42 toward the pivot bracket 34. As the actuation frame 42 is urged further toward the pivot bracket 34 the plow wing 14*a,* 14*b* pivots about the sweep pivot 32 rearward and away from the vehicle 12.

The sweep actuator 40 may utilize a motor, such as a linear motor, a linear actuator, a motorized compressor, or the like, to drive the actuator 40. Preferably, the sweep actuator 40 is a fluid powered cylinder such as a hydraulic cylinder. The sweep actuator 40 is configured to absorb at least a portion of an impact force from an object or obstacle striking or colliding with the wing 14*a,* 14*b* such that damage to the wing 14*a,* 14*b,* the actuator 40, or the support frame 16 can be avoided, or at least reduced or minimized.

In the illustrated embodiment, a hydraulic accumulator or shock absorber 25 is disposed with each of the plow wings 14*a,* 14*b* to absorb at least a portion of impact forces due to strikes with heavy or fixed foreign objects or obstacles (FIGS. 1, 4, 6, and 7). Accumulators 25 provide a "break away" or disabling relief to the plow wings 14*a,* 14*b* such that the wings 14*a,* 14*b* effectively release, open, or pivot away from the heavy object, fixed object, or obstacle to protect the snow plow apparatus 10 from extensive damage or minimize damage to the snow plow apparatus 10 and/or vehicle 12. The accumulator 25 is configured to allow the wings 14*a,* 14*b* to remain in a set position under a load or force that would be expected during snow removal and to "break away" or release when the wing 14*a* or 14*b* encounters a load or force that is substantially greater than expected during normal operation. The accumulator 25 and actuators 36, 40 coordinate to return the plow wings 14*a,* 14*b* to the previous set position after an impact has occurred that has caused the wings 14*a,* 14*b* to break away. The accumulator 25 may be pressurized, such as charged with nitrogen gas, to provide a biasing force that returns a wing 14*a,* 14*b* to its original position.

Figure 8A:
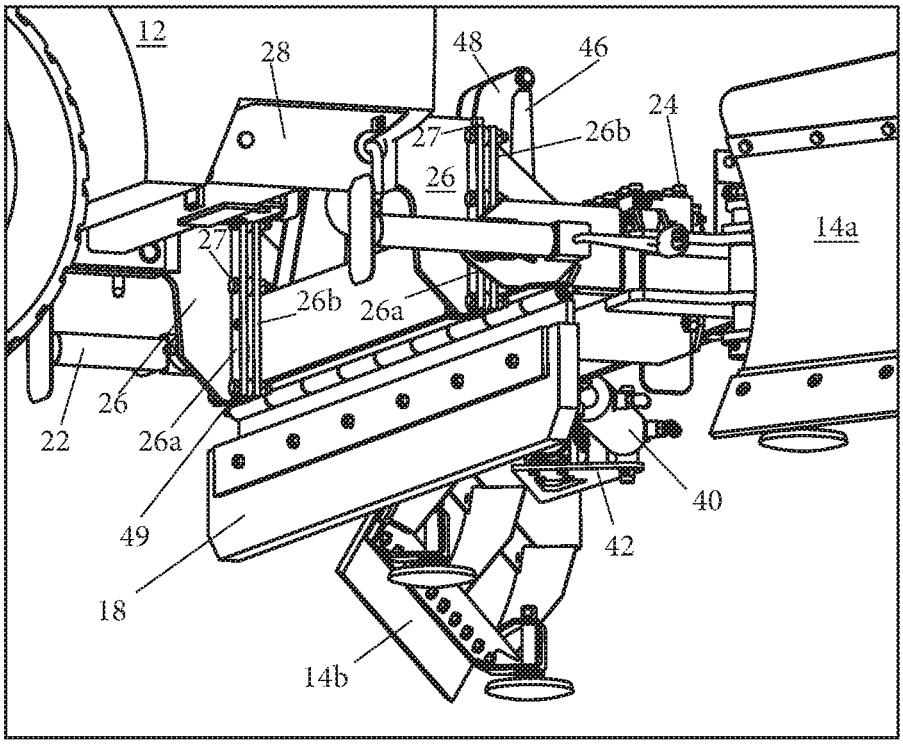
FIGS. 8A and 8B are bottom-front perspective views of the wing plow system, shown with the plow wings deployed and with the center plow blade shown deployed and stowed, respectively.
Figure 8B:
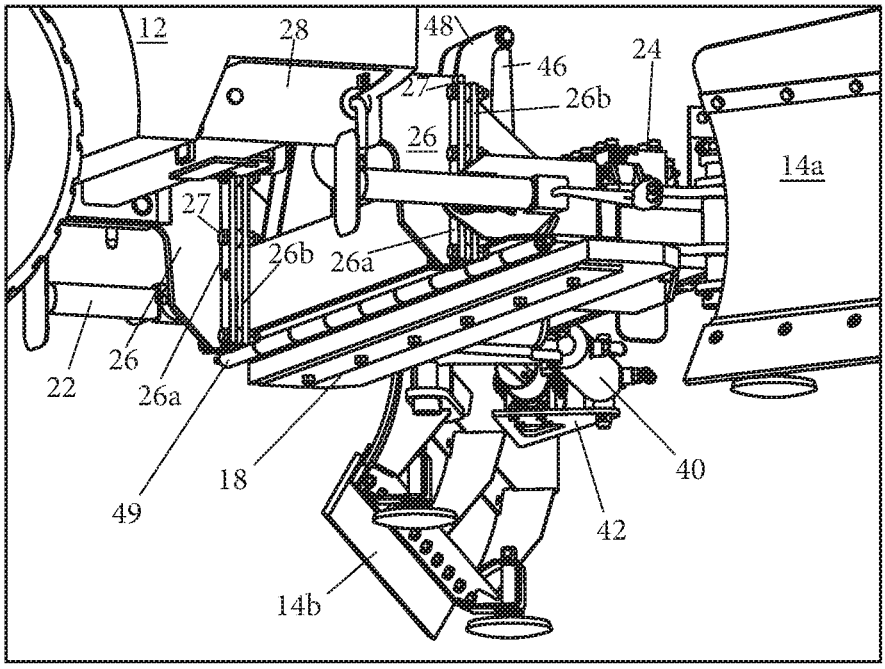
Figure 9A:
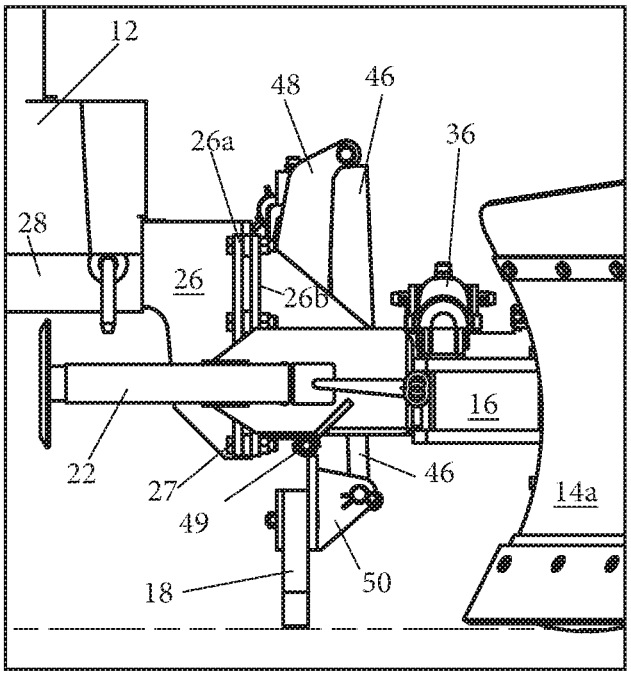
FIGS. 9A and 9B are left side elevations of the wing plow system, shown with the plow wings deployed and with the center plow blade shown deployed and stowed, respectively.
Figure 9B:
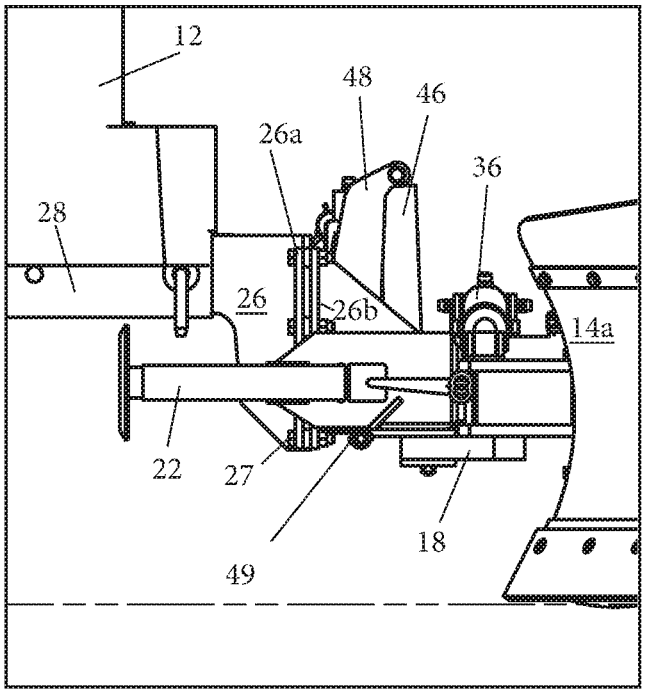

The center pivotable plate or plow blade 18 is pivotably coupled to a lower portion of the support frame 16, such as shown in FIGS. 8A-9B. Center blade 18 is configured to pivotably deploy from a stowed position where the center blade 18 is parallel to the surface to be plowed to a deployed position where the center blade 18 is substantially perpendicular to the surface to be plowed (FIGS. 9A-9B). The center blade 18 includes at least one powered center blade actuator 46 (FIGS. 6A, 9A, and 10) is configured to move the center blade 18 from the stowed position to the deployed position. Preferably, as shown in FIGS. 6-9B, a pair of center blade actuators 46 are included with the center blade 18. The center actuator 46 is operably coupled at one end to a portion of a stanchion frame 48 (FIGS. 6-9B) disposed on the support frame 16 and at an opposite end to an actuation bracket 50 disposed on a portion of the center blade 18. The center actuator 46 is operable to actuate or pivot the plate 18 about a center blade pivot axis defined by a hinge 49 (FIGS. 8A-9B) that couples the center blade 18 to the support frame 16. The center plate pivot axis is a substantially horizontal axis that is substantially perpendicular to the forward-rearward direction of travel of the vehicle, and substantially parallel to the surface to be plowed.

From the center blade's stowed position, as each center actuator 46 extends, the actuator 46 urges the actuation bracket 50 away from the stanchion frame 48, as the actuation bracket 50 is urged further from the actuator 46 the center blade 18 continues to pivot about the center blade pivot axis downward and away from the center line of the support frame 16 and then forward toward the vehicle 12 until the center blade 18 is substantially upright or vertical. From the center blade's deployed configuration, as the center actuator 46 retracts, the actuator 46 pulls the actuation bracket 50 toward the stanchion frame 48. As the actuation bracket 50 is pulled closer to the stanchion frame 48 the center blade 18 pivots rearwardly away from the vehicle 12 and then upward and toward the support frame 16 until the center blade 18 is substantially horizontal or flat, as shown in FIGS. 8B and 9B. The center actuator 46 may utilize a motor, such as a linear motor, a linear actuator, a motorized compressor, or the like, to drive the actuator 46. Preferably, the center actuator 46 is a fluid powered cylinder such as a hydraulic cylinder.

The center actuator 46 is configured to absorb at least a portion of an impact force from an object or obstacle striking the plate 18 such that damage to the plate 18, the actuator 46, the support frame 16, and/or the vehicle 12 can be avoided, or at least reduced or minimized. Optionally, the center plow blade 18 includes an impact trip or release (not shown) configured to allow the center blade 18 to "break away" or release from the deployed position to the stowed position due to an impact event. Once an impact causes the center blade 18 to break away, the center blade 18 remains in the stowed position until an operator releases or deploys it back to the deployed position. Optionally, the impact trip or release includes a hydraulic accumulator (not shown) configured to allow the center blade 18 to break away due to an impact force. The hydraulic accumulator may be charged with nitrogen gas to provide a biasing force that returns the center blade 18 to its original position.

Figure 12:
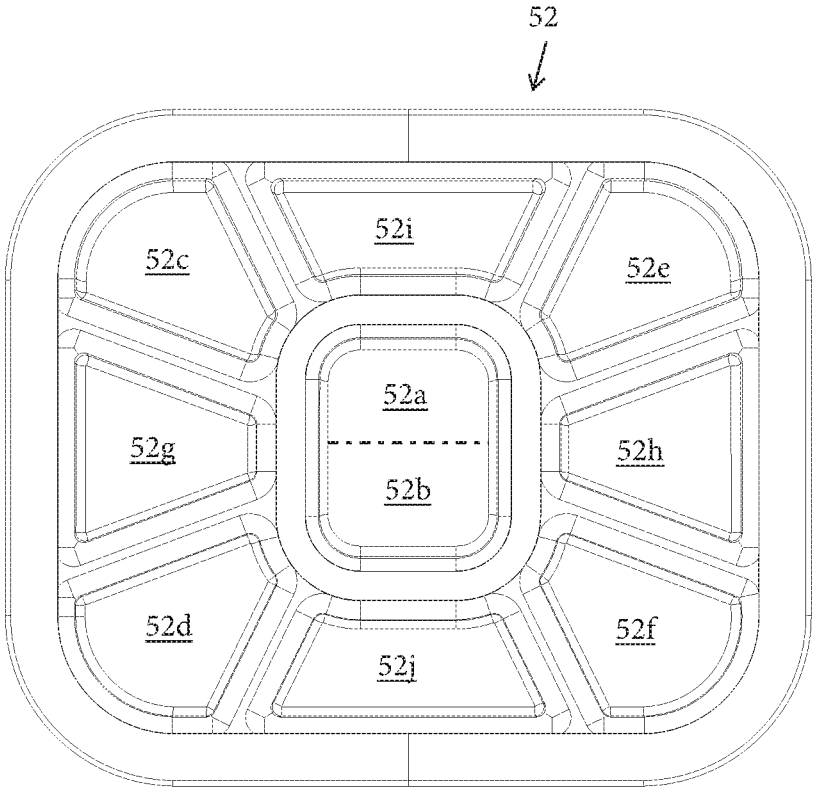
FIG. 12 is a schematic diagram of an exemplary remote control interface for controlling the wing plow system of FIG. 1.

Optionally, and as shown in FIGS. 1, and 4-7, an electronic controller and hydraulic circuit 24 is provided for controlling the various functions of snow plow apparatus 10. The controller and circuit 24 is operable to selectively activate each powered actuator 36, 40, 46 and control the flow of hydraulic fluid to the hydraulic cylinders of actuators 36, 40, 46, to control the actuation of the plow wings 14*a,* 14*b* and center plow blade 18, respectively. The controller and circuit 24 is operable by an operator to selectively control the deployment, stowage, and positioning of the snow plow apparatus 10. The controller and circuit 24 may be in communication with (and receive control signals from) a remote control, depicted as an exemplary keypad 52, to enable a user to operate the snow plow apparatus 10 from a location spaced apart from the snow plow apparatus 10 (FIG. 12). As illustrated, the remote control 52 is configurable for a plurality of snow plow apparatus operation functions which are selectable from a keypad 52. Optionally, the remote control 52 is in wireless communication with the controller and circuit 24.

The exemplary keypad 52 may be configured with the following key functions that are performed when the respective button is depressed: button 52*a* raises center blade 18 toward a stowed configuration; button 52*b* lowers center blade 18 toward a deployed configuration; button 52*c* raises left blade 14*a* toward a stowed configuration; button 52*d* lowers left blade 14*a* toward a deployed configuration; button 52*e* raises right blade 14*b* toward a stowed configuration; button 52*f* lowers right blade 14*b* toward a deployed configuration; button 52*g* moves the sweep position of left blade 14*a;* button 52*h* moves the sweep position of right blade 14*b;* button 52*i* moves all blades to the stowed configuration; button 52*j* moves all blade to a normal plowing position. The buttons of keypad 52 may be configured to perform multiple functions depending on the sequence that the button is depressed, for example, a first press of button 52*g* may move the left blade 14*a* to the normal sweep position (about 30° rearward), a second press may move the blade 14*a* to the forward-swept position, and a third press may move the blade 14*a* to a fully rearward-swept position.

Figure 10:
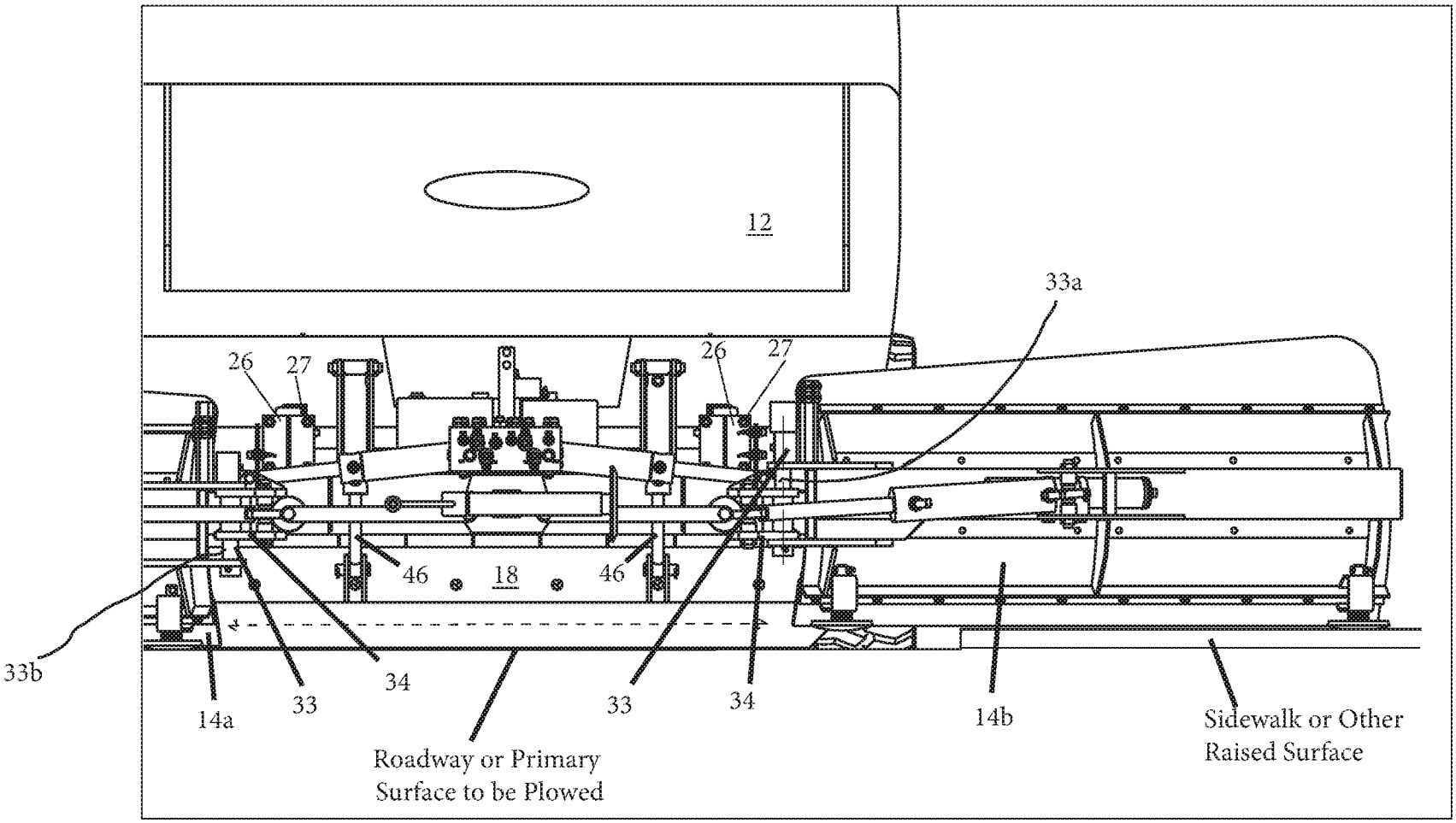
FIG. 10 is rear elevation of the wing plow system, with the wing plow blades deployed and positioned at different vertical heights for clearing surfaces at different elevations.

In the illustrated embodiment of FIG. 10, the plow wings 14*a,* 14*b* of the snow plow apparatus 10 are operable to "float", or freely raise and lower vertically, such that each of the plow wings 14*a,* 14*b* is operable to automatically adjust vertically due to vertical inconsistencies of the height of the surface to be plowed at the locations proximate to each plow wing 14*a,* 14*b*. For example, plow wing 14*a* may plow a roadway or primary surface at a first vertical height and plow wing 14*b* may plow a sidewalk surface adjacent to the street that is at a second vertical height, as illustrated in FIG. 10.

The "float" function of the plow wings 14*a*, 14*b* is achieved due to the connection between the plow wings 14*a*, 14*b* and the sweep pivot 32, wherein the wings 14*a*, 14*b* are coupled to the respective pivot bracket 34 with a float apparatus or system. In the illustrated embodiment of FIG. 10, the float apparatus includes a float shaft 33*a*, 33*b* that is disposed at the sweep pivot 32, such that the float shaft 33 can slide in a pair of vertically aligned through holes (not shown) formed in the upper and lower portions of the bracket 34 allowing the wings 14*a*, 14*b* to float, vertically slide, or track upward and downward in the vertical direction relative to the respective pivot bracket 34. As shown in the illustrated embodiment, the float shaft 33 is disposed along the axis of the sweep pivot 32 (FIG. 10). When the plow wings 14*a*, 14*b* are in the lowered or non-float position, the float shaft 33 is in a fully lowered position relative to the pivot bracket 34 such that a lower shaft portion 33*b* is exposed. As the plow wings 14*a*, 14*b* encounter changes in elevation of the surface to be plowed, the float shaft 33 raises or slides upward relative to the pivot bracket 34 until it reaches a raised or maximum float height where the float shaft 33 is at the highest capable position relative to the pivot bracket 34 such that an upper shaft portion 33*a* is exposed. The float apparatus is configured such that the inboard end of each plow wing 14*a*, 14*b* is moveable an equal distance as the outboard end of the corresponding plow wing 14*a*, 14*b* in relation to the axis of the sweep pivot or upright sweep axis. In other words, the inboard and outboard ends of respective plow wings 14*a*, 14*b* may raise and lower at substantially equal rates parallel and relative to the corresponding float shaft 33*a*, 33*b*. Thus, the inboard and outboard ends of respective plow wings 14*a*, 14*b* may raise and lower at substantially equal rates parallel and relative to the surface to be plowed, at least somewhat independently of the position of the longitudinal pivot bracket 34.

Plow wings 14*a,* 14*b* are pivotable about the respective sweep pivot 32 and are vertically slideable at the respective sweep pivot 32 such that when the wings 14*a,* 14*b* encounter changes in elevation of a surface proximate the vehicle 12, each wing 14*a,* 14*b* remains in a substantially horizontal orientation relative to the vehicle direction of travel as it floats to adjust for elevation changes of the surface being plowed. Preferably, the float feature is automatic and requires no power, mechanical assistance, or interaction by an operator to enable the float feature. Optionally, the center plow blade 18 is also operable to "float", or freely raise and lower vertically due to vertical inconsistencies of the height of the surface to be plowed proximate to the center plow blade 18.

The plow wings 14*a,* 14*b* of the snow plow apparatus 10 are further operable to "float-pivot", or somewhat freely pivot (against the biasing force of a spring or accumulator) about the longitudinal axis to at least a limited extent, such that when the wings 14*a,* 14*b* encounter uneven terrain of the surface proximate the vehicle 12, each wing 14*a,* 14*b* can remain in contact with the surface to be plowed at the proximal end and the distal end of the plow wing 14*a,* 14*b* without imparting excessive loads to the vehicle, even when the terrain proximate both the proximal end and the distal end are not at equal elevations. The float-pivot function allows the plow wing 14*a,* 14*b* to track uneven terrain while maintaining at least partial contact with the surface to be plowed. For example, for a sloping roadway shoulder surface, the plow wing 14*a,* 14*b* float-pivots to at least partially match the slope of the roadway shoulder such that the proximal end of plow wing 14*a,* 14*b* may plow an inner section of the roadway shoulder at a first vertical height and the distal end of the plow wing 14*a,* 14*b* may plow an outer portion of the roadway shoulder adjacent to the street that is at a second vertical height at a lower elevation than the first vertical height.

The float-pivot function of the plow wing 14*a,* 14*b* is achieved due to the connection between the plow wing 14*a,* 14*b* and the deployment actuator 36, wherein the deployment actuator 36 is operable to release or remain passive when not operating to raise or lower the plow wing 14*a,* 14*b,* such that when the plow wing 14*a,* 14*b* encounters uneven terrain, the deployment actuator 36 does not impede the plow wing 14*a,* 14*b* from pivoting about the longitudinal axis. Optionally, the deployment actuator 36 may be adapted to hydraulically "float", such that pressurized gas in the actuator 36 may at least partially expand or compress to allow the plow wing to somewhat freely pivot up or down about the longitudinal axis. A hydraulic float valve (not shown) may be disposed with the deployment actuator 36 to allow the actuator 36 to float to allow the plow wing 14*a,* 14*b* to somewhat freely pivot (against the biasing force of a spring or accumulator) about the longitudinal axis to at least a limited extent.

Figure 6:
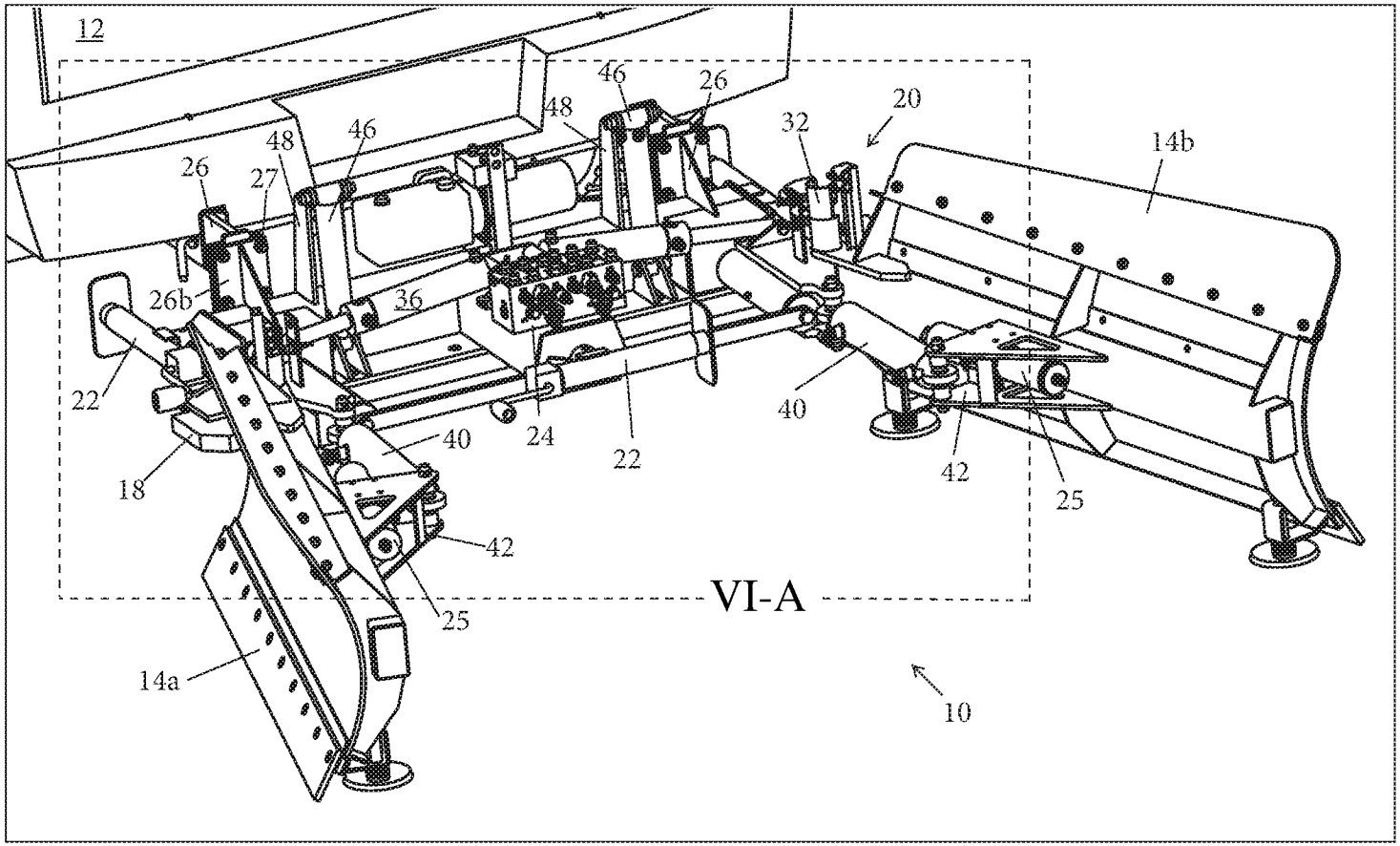
FIG. 6 is another rear perspective view of the system of FIG. 1, with the plow wings deployed and positioned in a fully rearward-swept configuration.
Figure 6A:
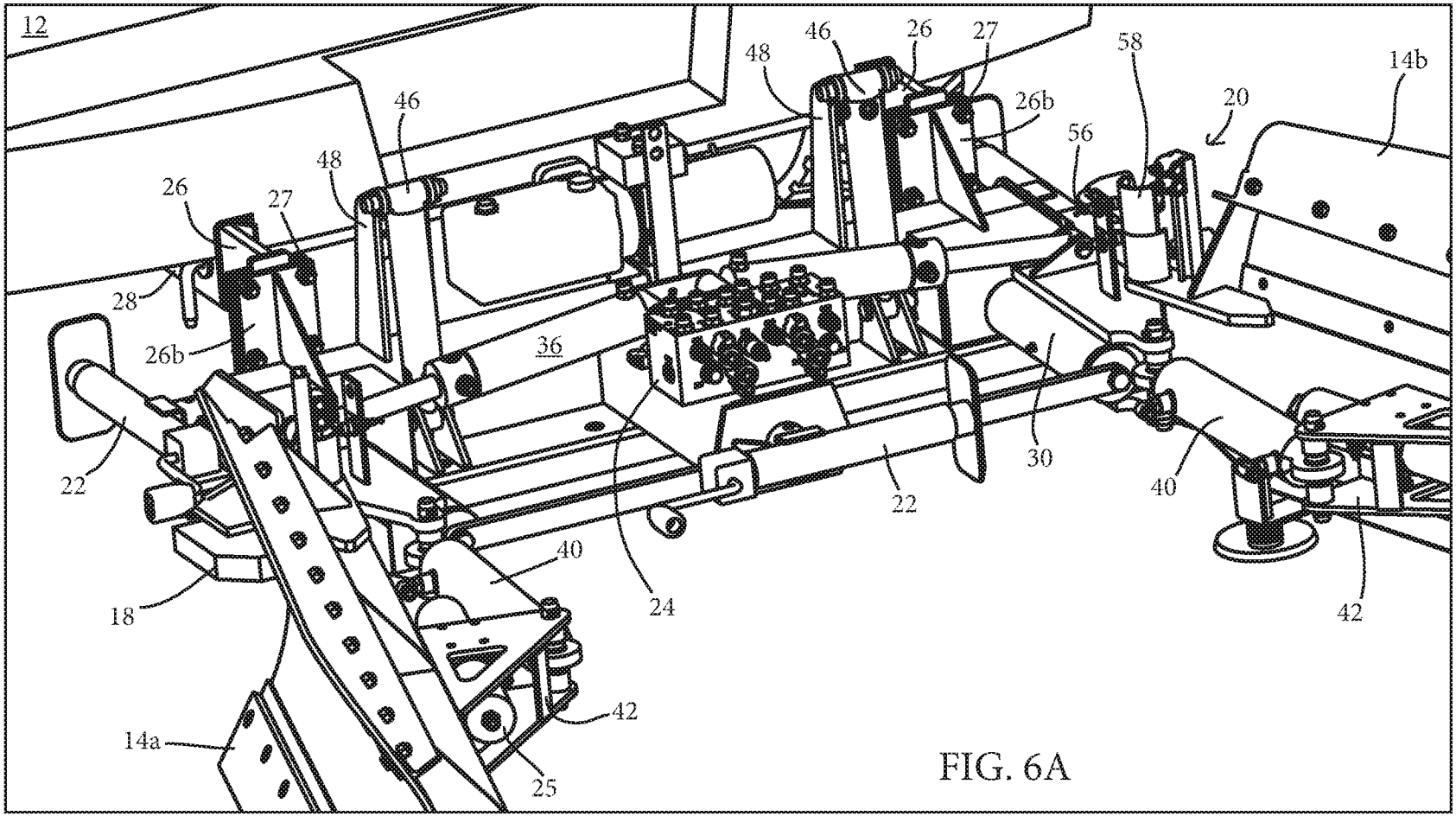
FIG. 6A is an enlarged view of the region designated VI-A in FIG. 6.
Figure 7:
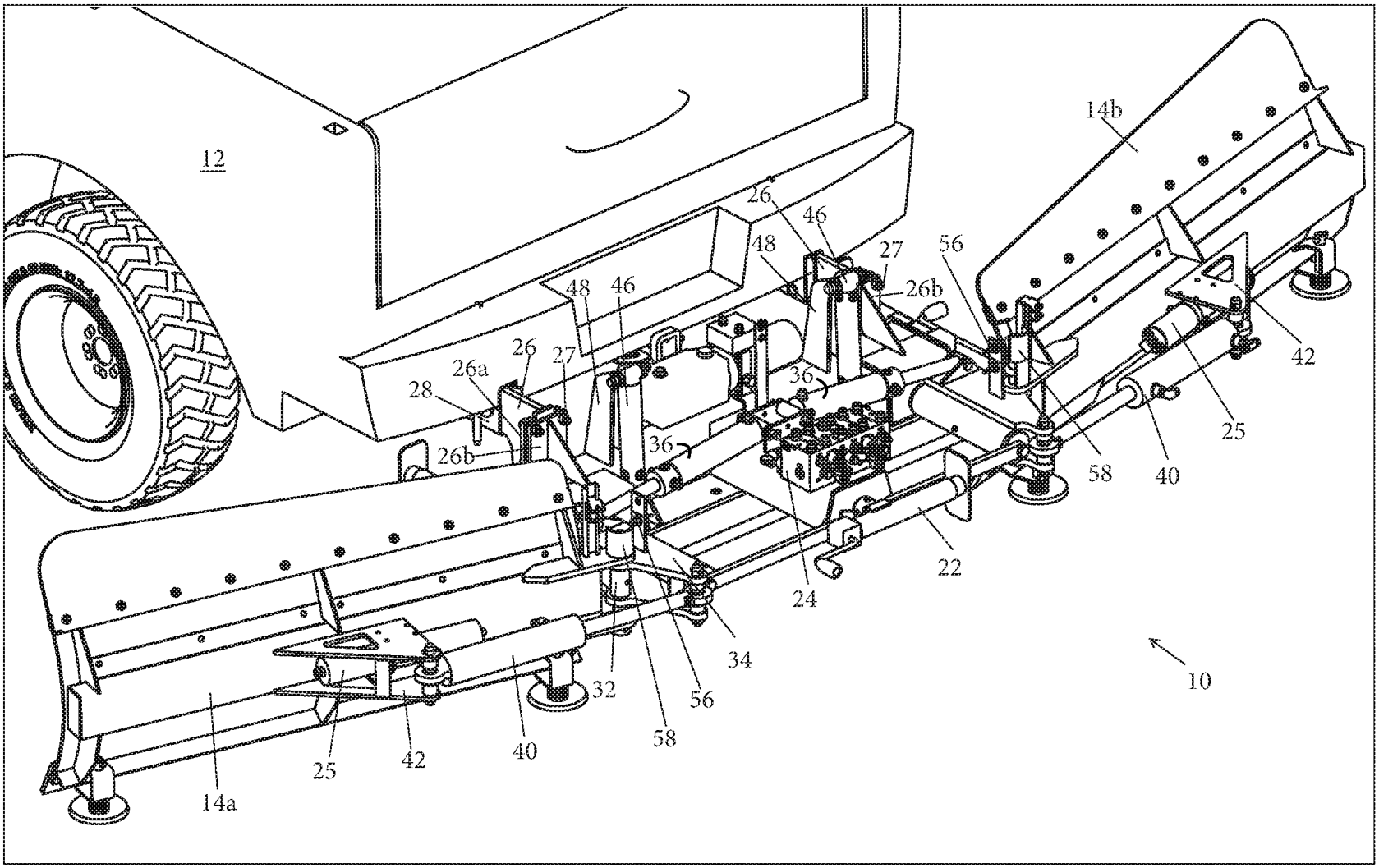
FIG. 7 is another rear perspective view of the system of FIG. 1, with the plow wings deployed and positioned partially forward of perpendicular to the forward direction of travel of the vehicle.
Figure 11:
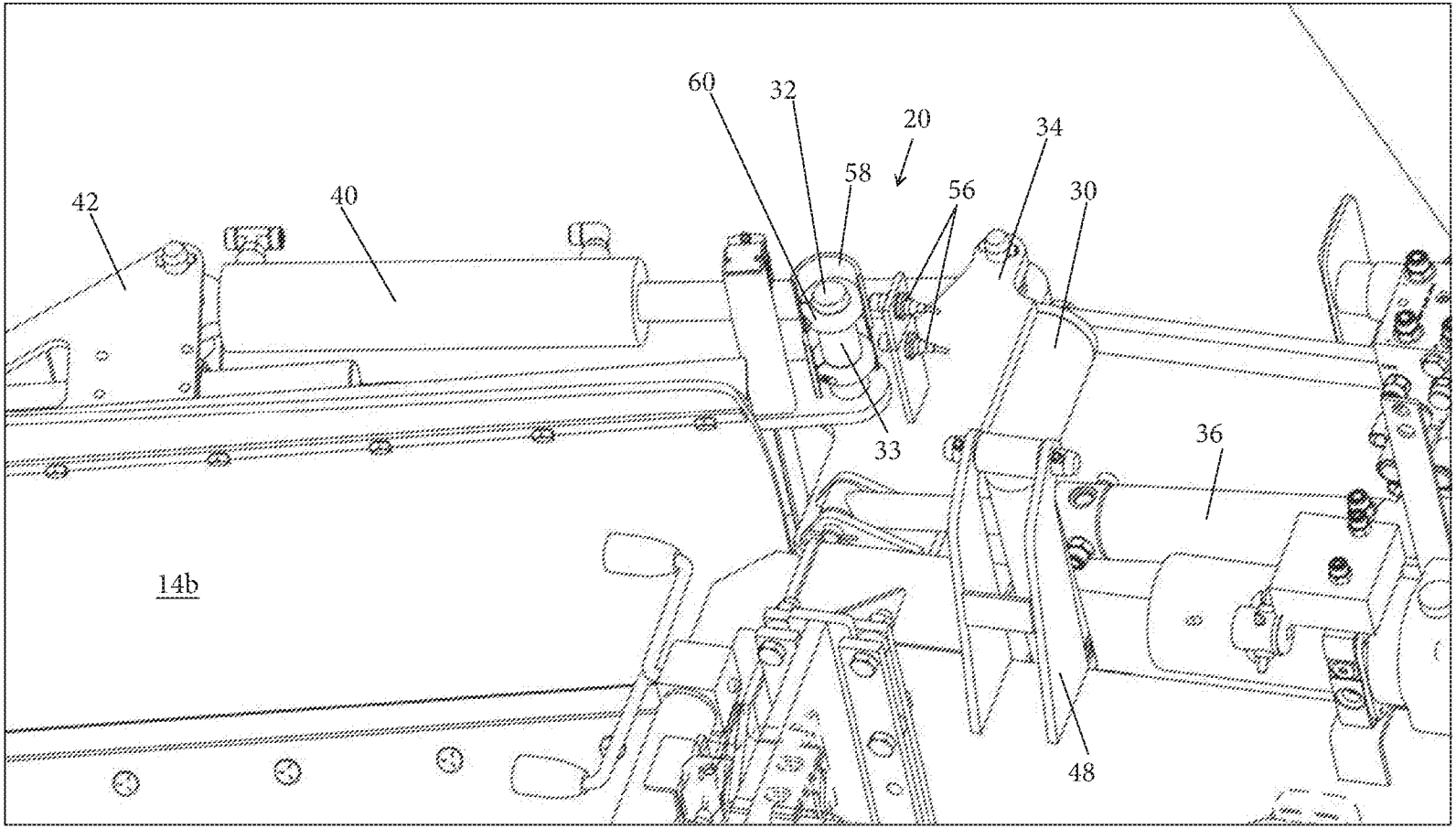
FIG. 11 is an enlarged front-top perspective view of a portion of the system of FIG. 1, depicting an optional blade location sensor apparatus.

Plate position indicators, in the form of electronic sensors 20, are disposed at or proximate to the sweep pivots 32 to communicate position information of the plow wings 14*a,* 14*b* to an operator. (FIGS. 1, 6, and 7). As illustrated in FIG. 11, plate position sensors 20 include at least one contactless position sensor 56 configured to sense position or angle information of the plow wings 14*a,* 14*b* relative to the support frame 16. As further illustrated in FIG. 11, the plate position sensors 20 include at least one target 58 disposed about the sweep pivot 32 that is configured to provide a target, reflector, or indicator to be viewed or sensed by the contactless position sensor 56. The target 58 is coupled to an adjustable clamp or collar 60 that is configured to adjustably couple the sweep pivot 32 to allow for adjustment of the target 58 relative to the sweep pivot 32. The target 58 is repositionable about the respective sweep pivot 32 relative to the contactless position sensor 56 such that an operator can choose a desired angle or position of the plow wings 14*a,* 14*b* at which the position sensor will alert the operator. As the plow wings 14*a,* 14*b* pivot, the target 58 rotates about the respective sweep pivot 32 and position sensor 56 senses whether the target 58 is in the field of view of the sensor 56 or not. Optionally, the position sensor 56 is capable of sensing varying degrees of pivot of the wings 14*a*, 14*b*.

Figure 5:
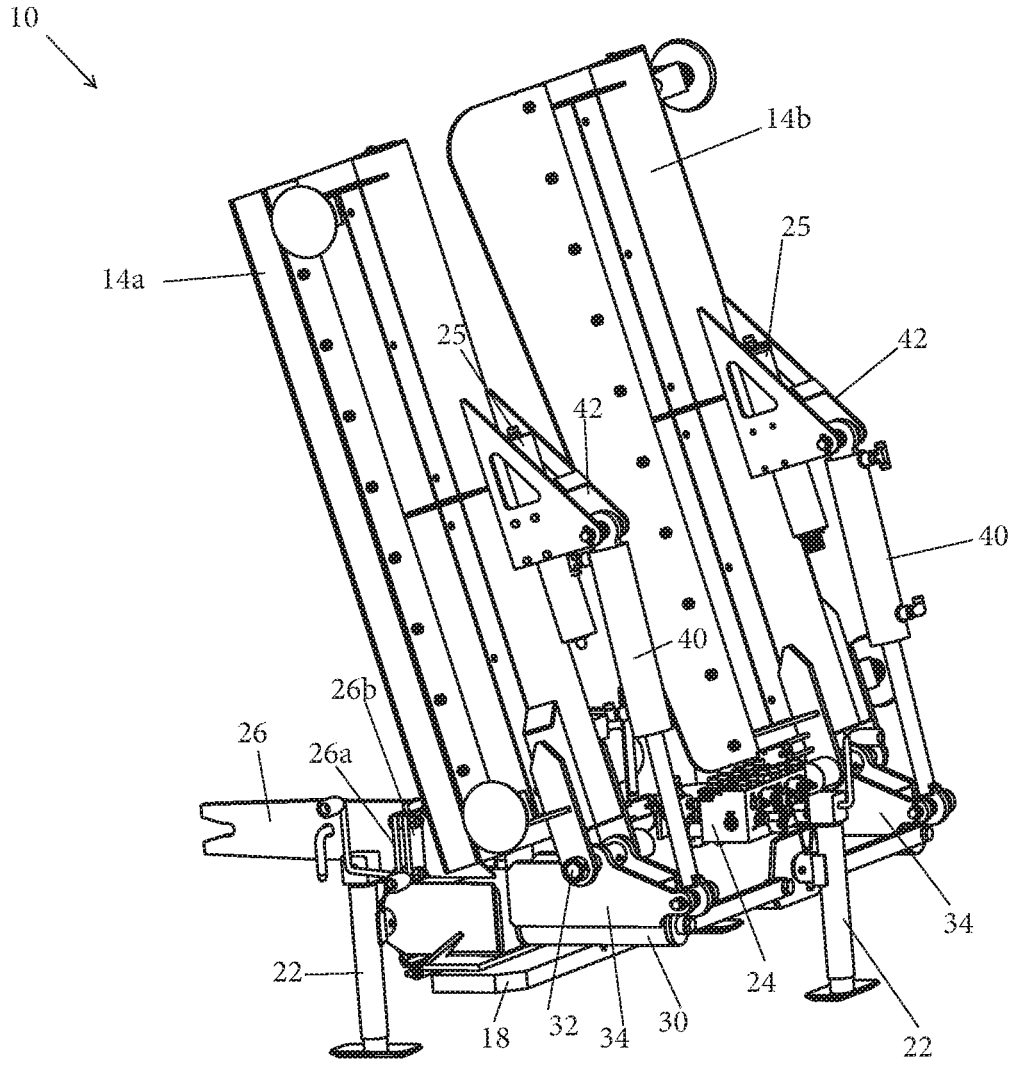
FIG. 5 is a rear perspective view of the wing plow system configured for storage while it is detached from a vehicle.

Support elements, such as jack stands 22, are provided at a plurality of locations about the support frame 16 and are configured to support the snow plow apparatus 10 on the ground or a surface below the snow plow apparatus 10 when the snow plow apparatus 10 is removed from the vehicle 12 or being stored away from the vehicle 12 (FIGS. 1 and 5). The jack stands 22 may be manually operated to raise or lower, or the jack stands 22 may include a motor or actuator to raise or lower them. In one embodiment, as illustrated, the jack stands 22 are pivotable in relation to the support frame 16 such that the jack stands may be stowed while the snow plow apparatus 10 is coupled with the vehicle 12 or deployed to assist with removal of the snow plow apparatus 10 from the vehicle 12 and for storage of the snow plow apparatus 10 apart from the vehicle 12. The jack stands 22 extend downward from the support frame 16 toward the ground surface subjacent to the support frame 16. Once the jack stands 22 contact the subjacent surface they are lockable relative to the support frame 16 to support the snow plow apparatus 10 on the ground surface. Optionally, the jack stands 22 are further downwardly extendable such that the jack stands 22 can further lift the snow plow apparatus 10 further off of the ground. A motor or actuator (not shown) may be included to assist in deployment of the jack stands 22.

Referring to FIGS. 13-21, another snow plow apparatus 110 is configured to mount to a vehicle 112 and includes a single pivotable plow wing, plow, plate, or blade 114 and a support frame 116. Similar to the snow plow apparatus 10 of FIGS. 1-11 as described above, the snow plow apparatus 110 is pivotably coupled to the vehicle 112, such as with vehicle frame mounts 26 similar that described for apparatus 10, and is selectively deployable from a raised stowed configuration to a lowered deployed configuration for removing snow and other debris from a surface proximate the vehicle 112. A notable difference between the dual-wing plow apparatus 10 of FIGS. 1-11 and the single-wing plow apparatus 110 of FIGS. 13-21 is that the single plow wing 114 is selectively deployable at either the left side or the right side of the vehicle 112, relative to the forward direction of travel of the vehicle 112. The plow wing 114 is pivotably coupled with the support frame 116 such that the wing 114 is laterally pivotable about a longitudinal axis that is substantially parallel to the forward-rearward direction of travel of the vehicle 12. A longitudinal hinge or pivot 118 is disposed at a center portion of the support frame 116 and provided to rotatably or pivotably support the wing 114 about its proximal or inboard end 114*a* (FIGS. 13-19). As illustrated in sequential order in FIGS. 16A-16I, the wing 114 is operable to pivot or rotate about longitudinal pivot 118, such that a distal or outboard end 114*b* of the wing 114 is movable through an arc defined in a plane that is substantially perpendicular to the longitudinal axis and the direction of travel of the vehicle 112. As illustrated in FIGS. 16A-16I, the plow wing 114 is pivotable through about 180° about the longitudinal axis from one side to the other.

Figure 13:
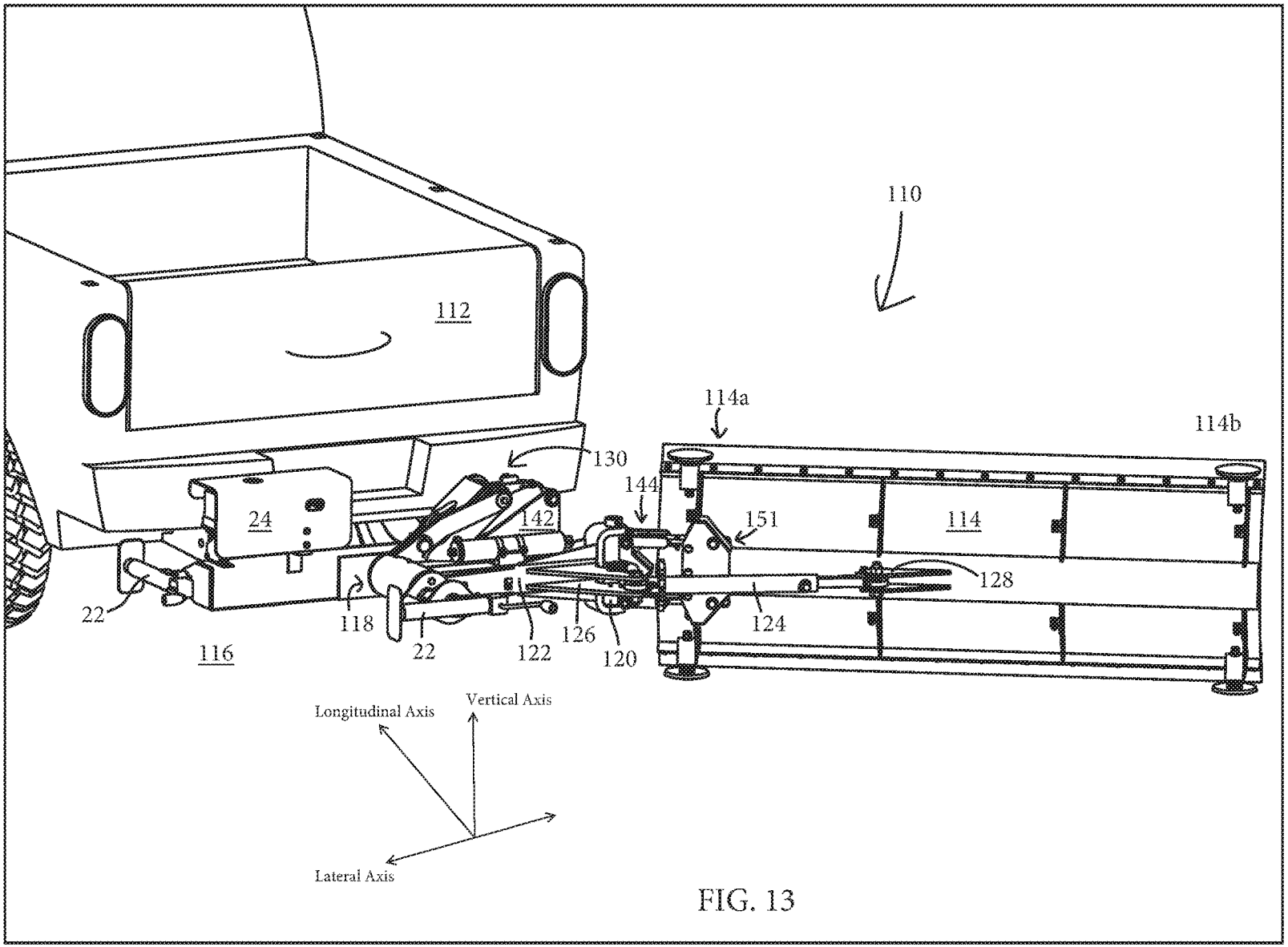
FIG. 13 is a rear perspective view of another vehicle mounted wing plow system in accordance with the present invention, with single plow wing deployed outboard of the right side of the vehicle.
Figure 14:
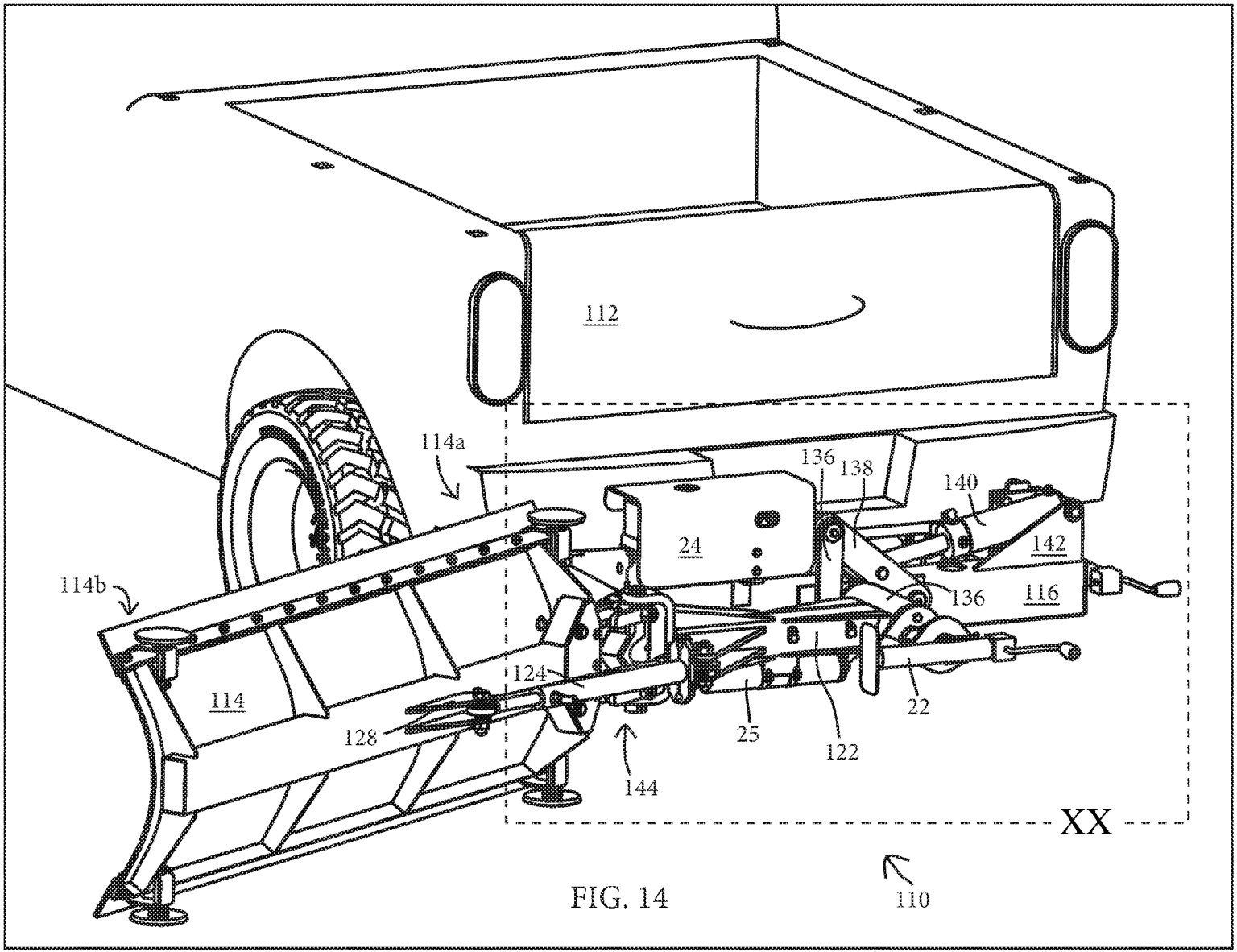
FIG. 14 is a rear perspective view of the vehicle mounted wing plow system of FIG. 13, with single plow wing deployed outboard of the left side of the vehicle.
Figure 19:
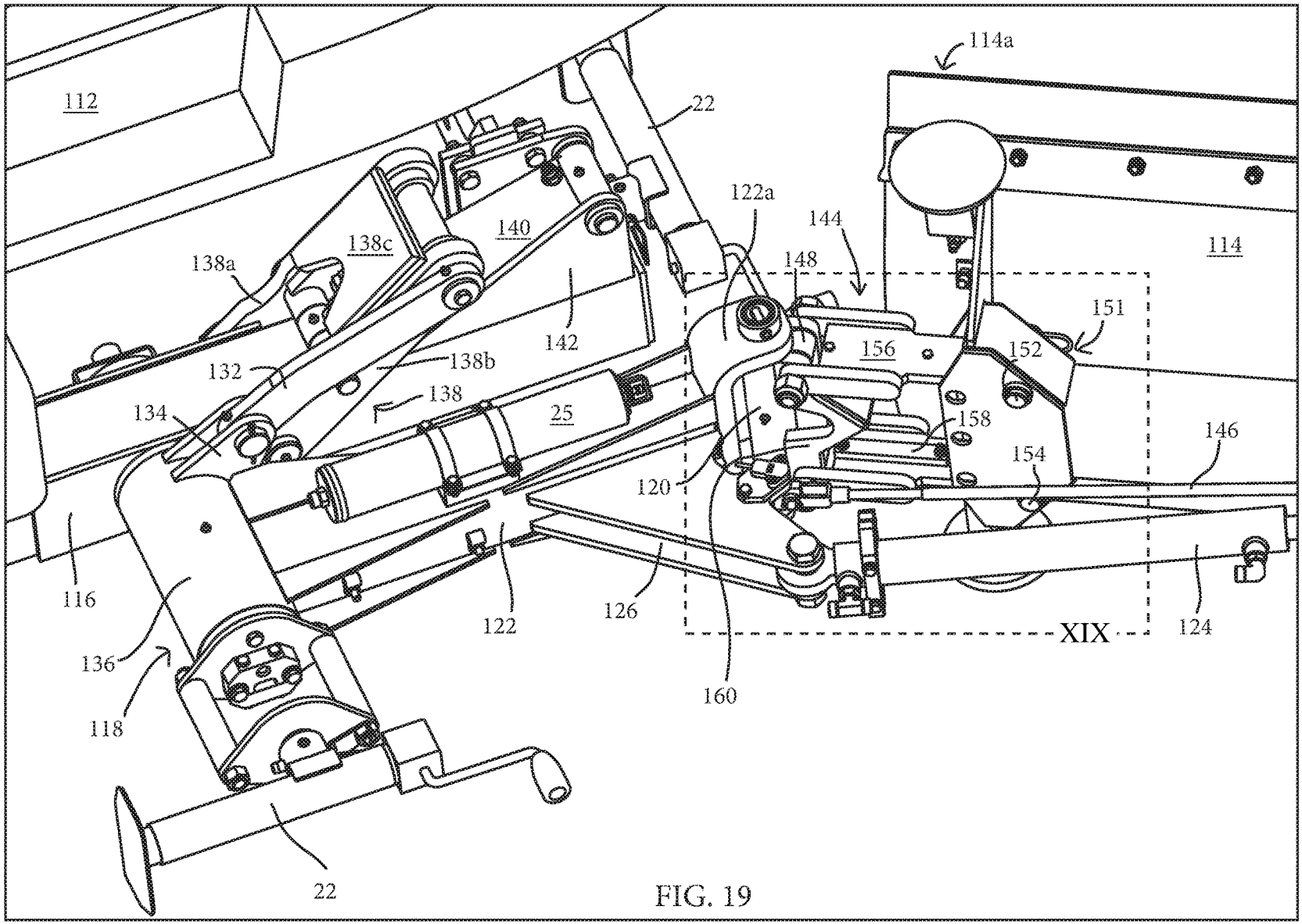
FIG. 19 is an enlarged rear-top perspective view of a powered plow wing pivot actuation mechanism of the vehicle mounted wing plow system of FIG. 13.
Figure 20:
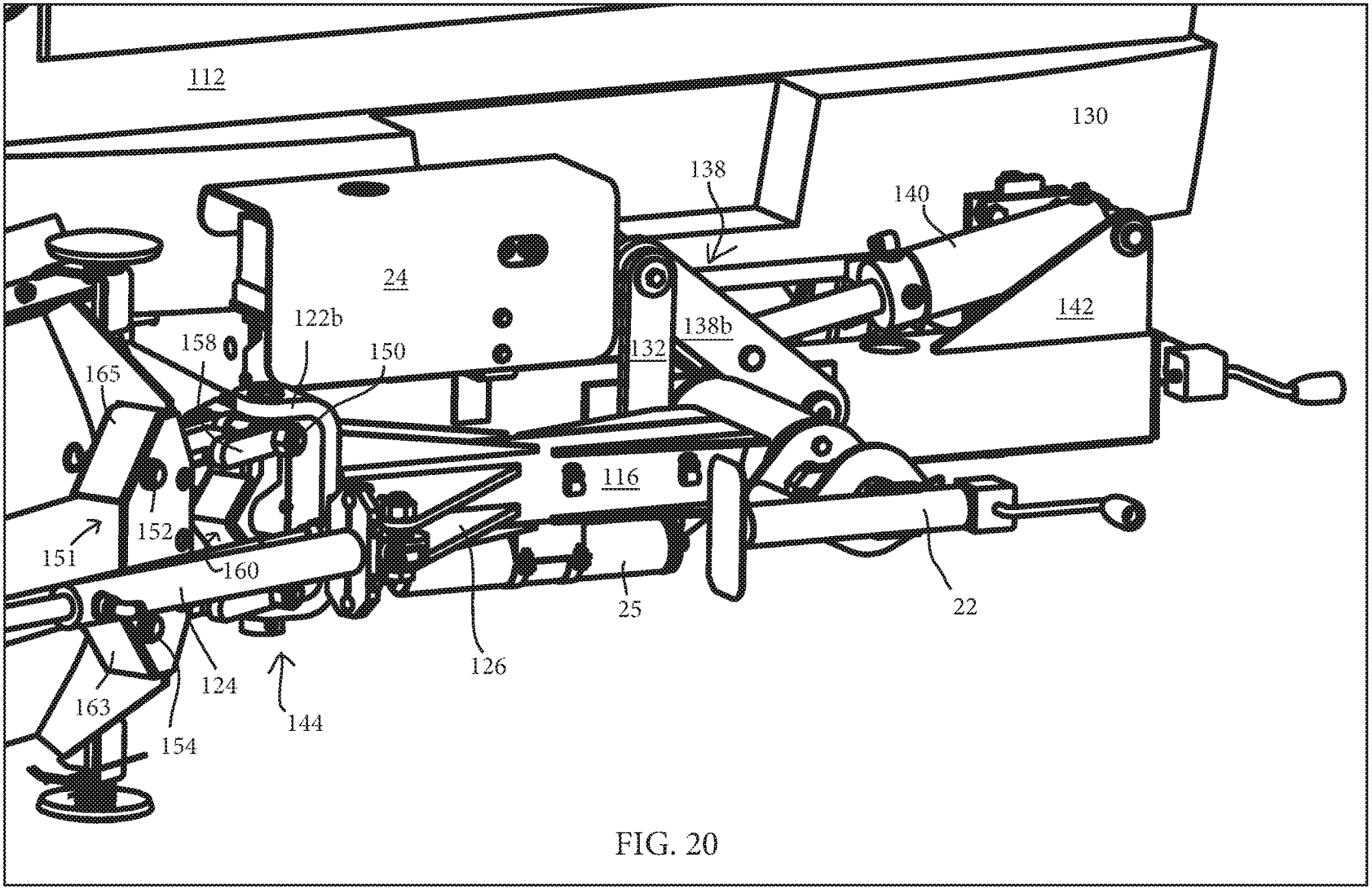
FIG. 20 is an enlarged view of the region designated XX in FIG. 14.
Figure 21:
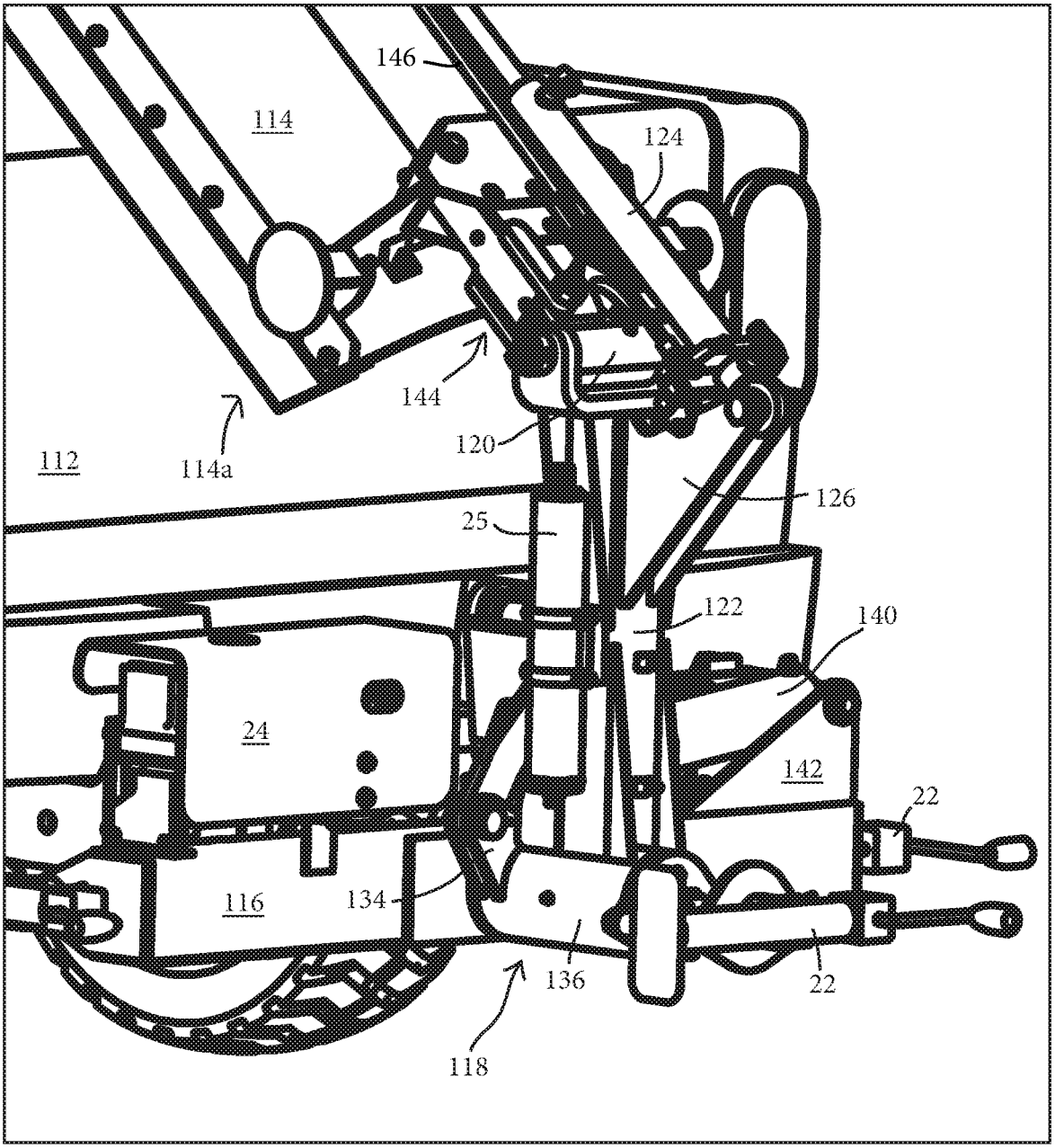
FIG. 21 is an enlarged view of the region designated XXI in FIG. 15.

Similar to wings 14*a*, 14*b* described above, plow wing 114 is further pivotable about a sweep axis to sweep, pivot, or rotate the wing 114 about the sweep axis, which is substantially perpendicular to the longitudinal axis and substantially vertical relative to the longitudinal axis when the wing 114 is in the deployed configuration at either side of the vehicle 112. A sweep hinge or pivot 120 is disposed between the wing's proximal end 114*a* and a longitudinal pivot frame or arm 122. The longitudinal pivot arm 122 is coupled to the longitudinal pivot 118 and configured to pivot about the longitudinal axis (FIGS. 13-19). The pivot 120 is a rotatable shaft rotatably disposed between spaced-apart plates 122*a* and 122*b* that are disposed at the distal end of the pivot arm 122, as best illustrated in FIGS. 19 and 20. The plow wing 114 is operable to move or sweep about the sweep axis defined by the sweep pivot 120 when in the deployed configuration, such that the wing's distal end 114*b* is movable through an arc defined in a plane that is substantially parallel to the surface to be plowed, such as shown in FIGS. 17A-17D, which depict a sequence of sweeping or moving the plow wing 114 from a partially forward-swept position to a substantially rearward-swept position, similar to the sweep positions described for apparatus 10 previously. The snow plow apparatus 110 includes a powered sweep actuation mechanism having an extendable actuator 124 that is similar in structure and functionality to the sweep actuator 40 described previously. The powered sweep actuator 124 is coupled at one end to a portion of a pivot bracket 126 that is coupled at one end to the pivot frame 122, and at an opposite end to a plate actuation bracket 128 that is disposed at a middle region of the plow wing 114 (FIG. 13). The pivot bracket 126 includes a pair of spaced-apart plates extending rearward from pivot arm 122, with one plate positioned above the other, as best shown in FIG. 19. The plate actuation bracket 128 includes a pair of spaced-apart plates disposed on and extending rearward from the rear of the plate 114, as best shown in FIG. 14.

The snow plow apparatus 110 includes a plow wing pivot actuation mechanism 130 (FIGS. 19-21) that pivots the plow wing 114 about the longitudinal pivot 118 to move the plow wing 114 between the right-side deployed configuration (FIG. 16A), an upright configuration (FIG. 16E), the left-side deployed configuration (FIG. 16I), and various intermediate configurations (FIGS. 16B-16D and 16F-16H). The actuation mechanism 130 includes a strut or linkage arm 132 coupled to the longitudinal pivot 118 at a pivot bracket 134 (FIG. 19). The pivot bracket 134 includes a pair of spaced apart plates fixed to an outer sleeve or tube 136 that defines a portion of the longitudinal pivot 118. The sleeve 136 is pivotably coupled to the support frame 116 such that the sleeve 136 is pivotable about the longitudinal axis. When the actuation mechanism 130 actuates the linkage arm 132, the linkage arm 132 pushes the pivot bracket 134 which thereby rotates the sleeve 136 about the longitudinal pivot axis in a corresponding direction. The actuation mechanism 130 includes an intermediate strut or linkage arm assembly 138 pivotably coupled at one end to linkage arm 132 and at an opposite end to the support frame 116. In the illustrated embodiment of FIGS. 13-21, and as best shown in FIG. 19, the intermediate linkage assembly 138 includes a pair of arms 138*a*, 138*b* that are pivotably coupled to a forward side and a rearward side of the support frame 116, respectively. The pair or arms 138*a*, 138*b* are fixedly coupled to one another by a plate 138*c* such that the arms 138*a* and 138*b* move or actuate in unison. While the intermediate linkage assembly 138 is illustrated with a pair of arms 138*a*, 138*b*, it will be appreciated that a single arm may provide sufficient support, structure, and functionality, as an alternative.

A powered actuator 140 is operably coupled at one end to a center portion of the intermediate linkage assembly 138, such as at plate 138*c*, and at an opposite end to an actuator support bracket 142 that is coupled to the support frame 116 (FIG. 19). The actuator 140 is selectively operable, in cooperation with the intermediate linkage assembly 138, linkage arm 132, and pivot bracket 134, to rotate the sleeve 136 and thereby pivot the plow wing 114 about the longitudinal pivot 118. For example, with the plow wing 114 beginning in the right-side deployed configuration of FIG. 16A, the actuator 140 begins to extend and urges the linkage assembly 138 to pivot about its end coupled to the support frame 116 and the opposite end of the assembly 138 moves away from the support bracket 142. The movement of linkage arm 138 away from the support bracket 142 urges the linkage arm 132 to extend or move away from the linkage assembly 138. As the linkage arm 132 moves away from the linkage assembly 138, the arm 132 urges the pivot bracket 134 to move in a direction away from the actuation bracket 142 such that the movement of the pivot bracket 134 causes the sleeve 136 to rotate counter-clockwise, when viewed from behind the vehicle 112.

Figure 16A:
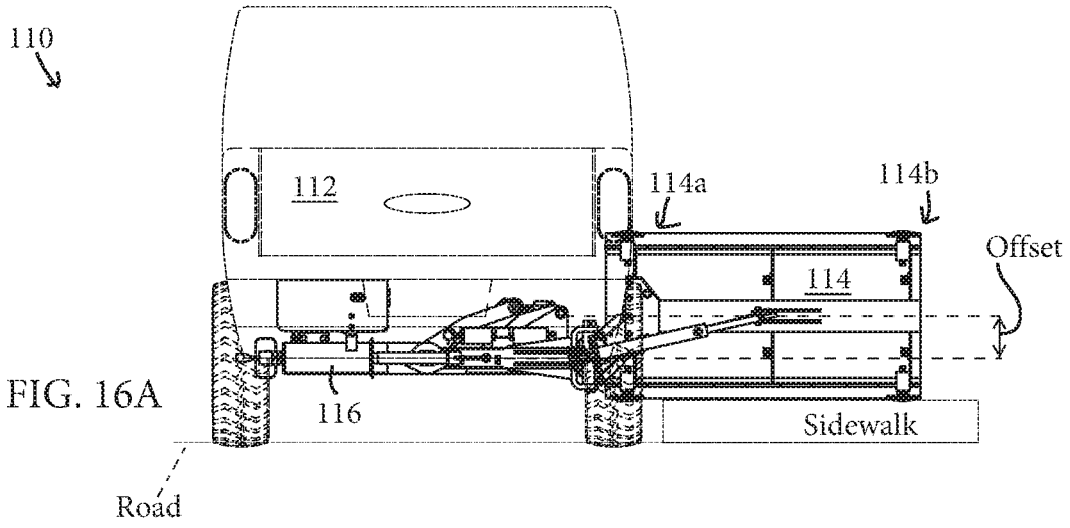
FIG. 16A-16I are rear elevation views of the system of FIG. 13, depicting sequential steps of moving the plow wings from outboard of the right side of the vehicle to outboard of the left side of the vehicle.
Figure 16B:
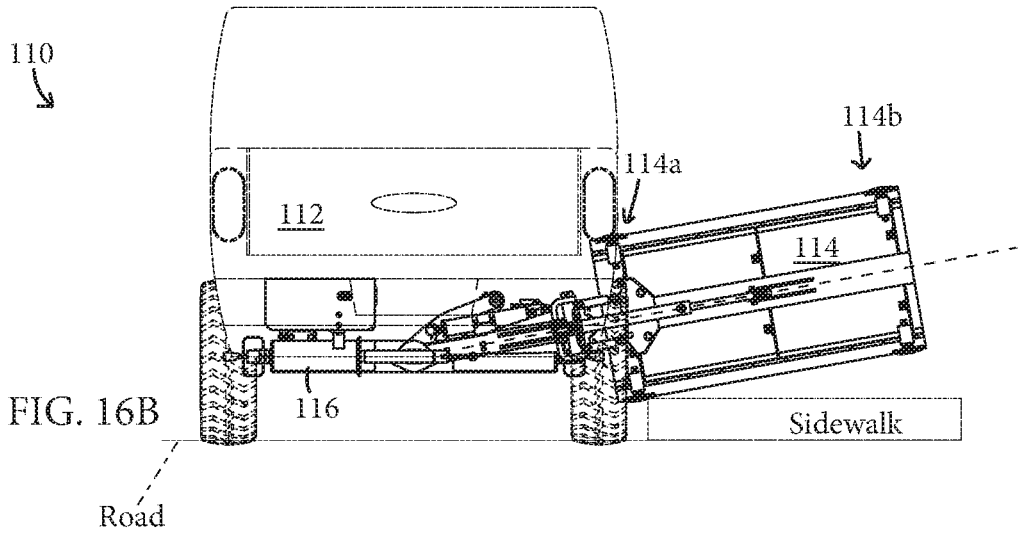
Figure 16C:
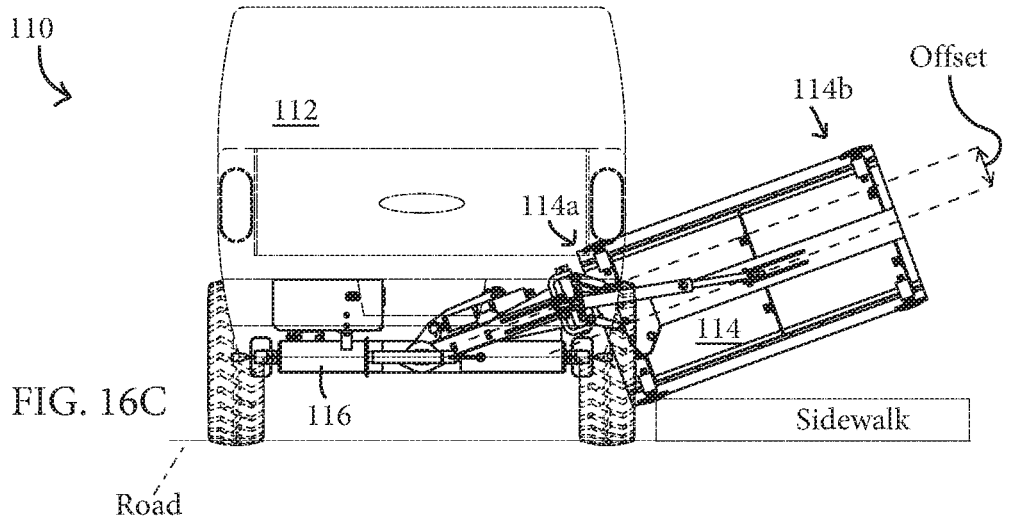
Figure 16D:
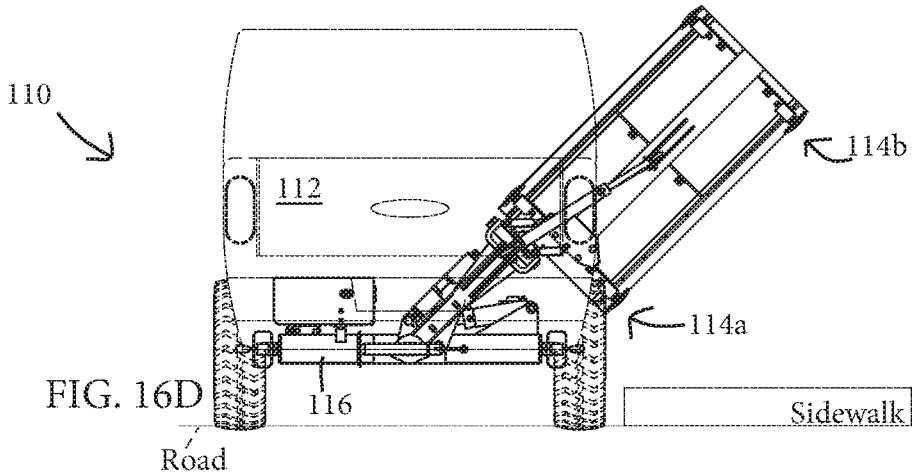
Figure 16E:
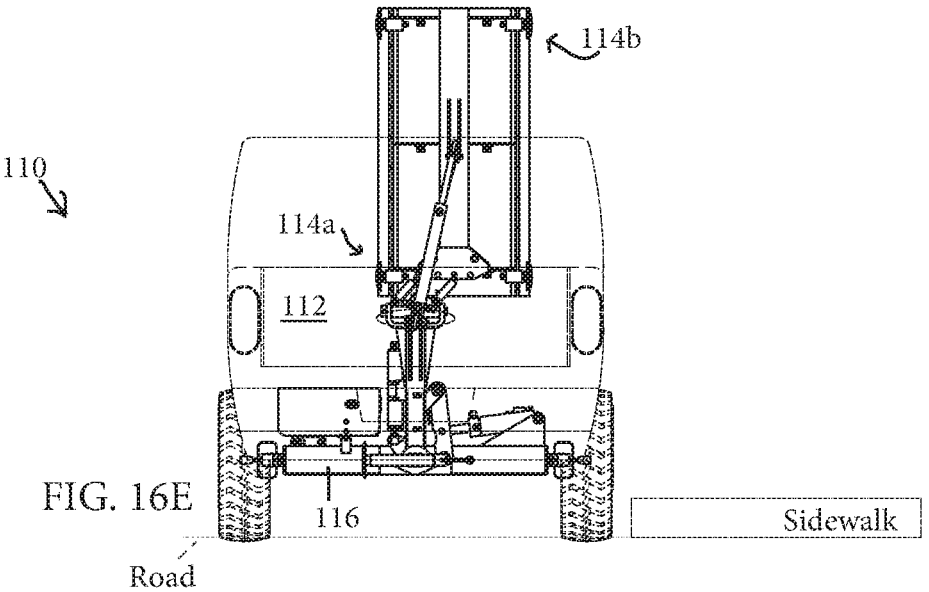
Figure 16F:
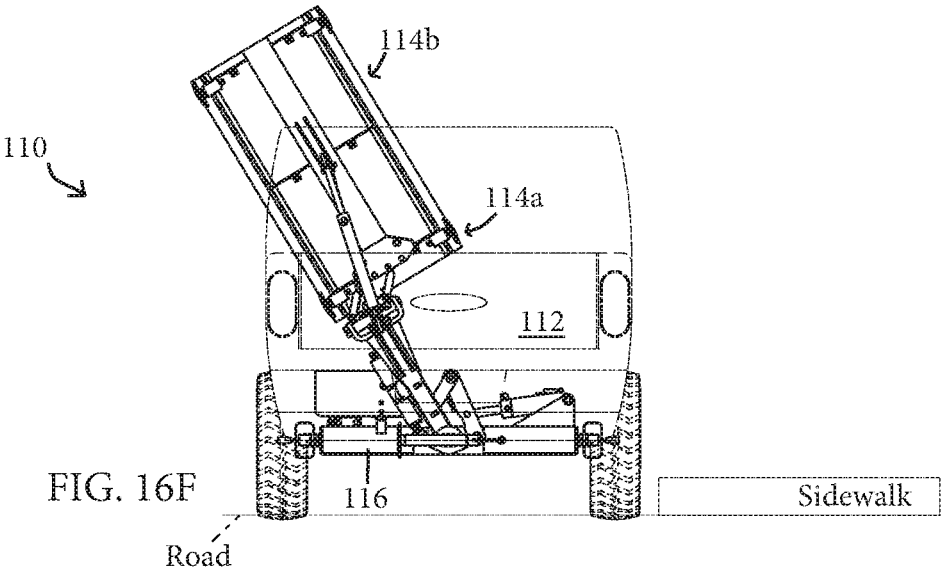
Figure 16G:
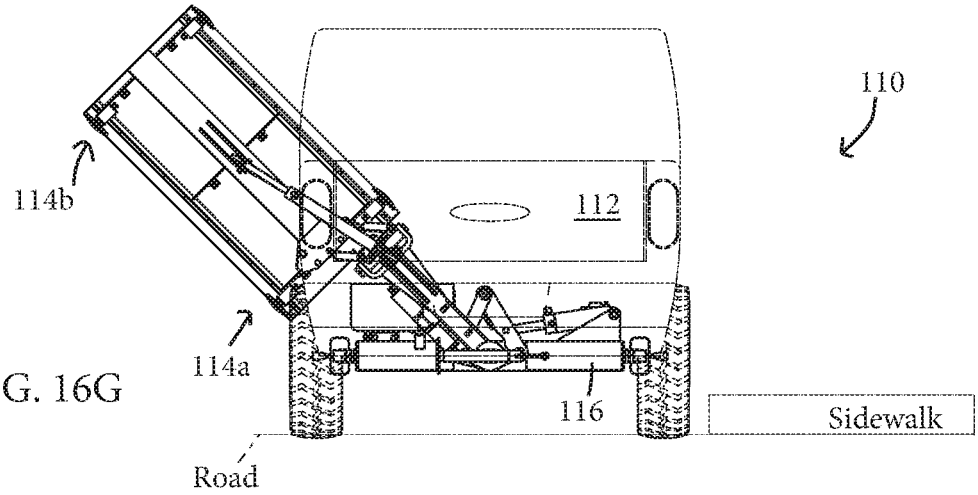
Figure 16H:
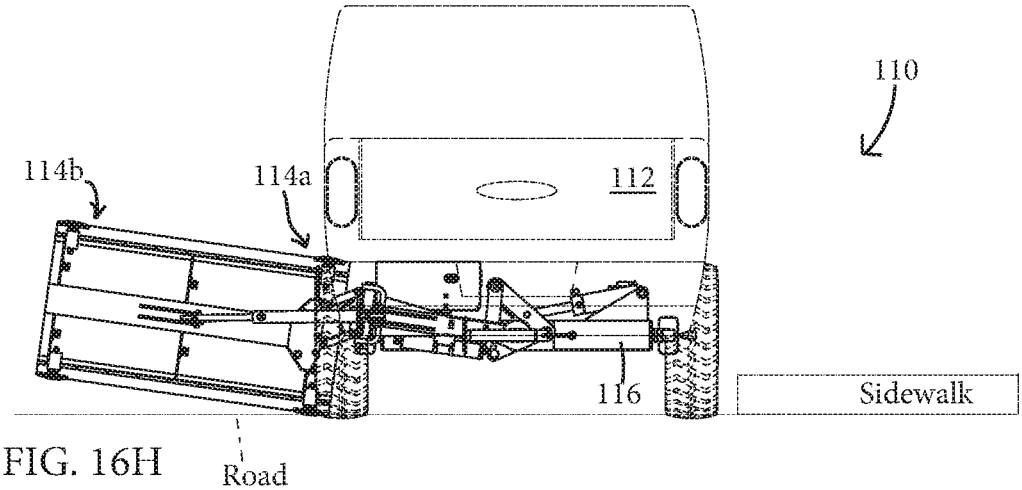
Figure 16I:
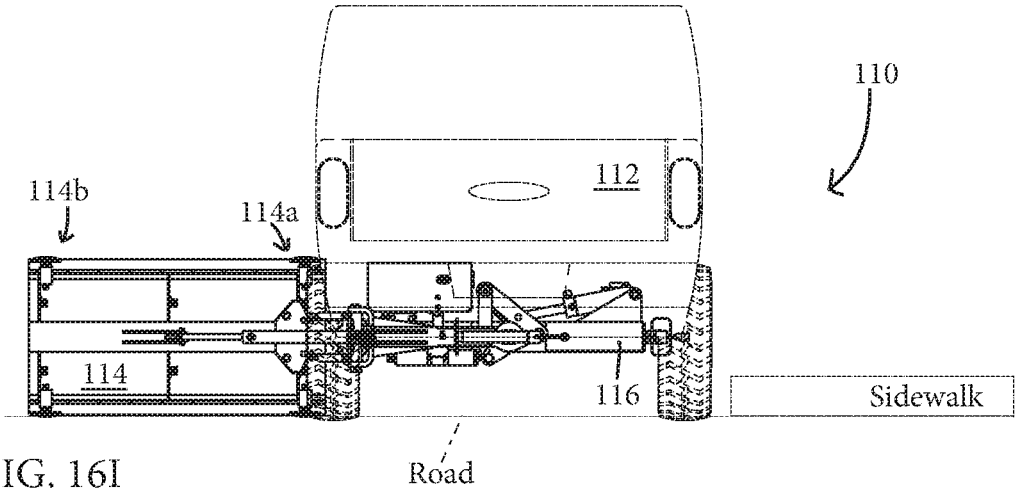

As illustrated in sequential order in FIGS. 16A-16E, the counter-clockwise rotation of the sleeve 136 rotates the plow wing 114 upward away from the plowed surface at the right side of the vehicle 112 and inboard toward an upright configuration (FIG. 16E). As illustrated in sequential order in FIGS. 16F-16I, as the actuation mechanism 130 continues to rotate the sleeve 136 counter-clockwise, the plow wing 114 is rotated outboard from the upright configuration (FIG. 16E) toward the left side of the vehicle 112 and downward toward the surface to be plowed at the left side of the vehicle 112 (FIG. 16I). The actuation sequence shown in FIGS. 16A-16I is followed in reverse to move the plow wing 114 from the left side of the vehicle 112 to the right side of the vehicle 112. To reverse the sequence, or in other words to move the plow wing 114 from the left side of the vehicle 112 to the right side, the actuator 140 retracts, causing the actuation mechanism 130 to pull the pivot bracket 134 toward the actuation bracket 142, thereby causing the sleeve 136 to rotate clockwise when viewed from the rear of the vehicle 112.

The snow plow apparatus 110 includes a controller and circuit 24 to operate the powered sweep actuator 124 and powered actuator 140 and performs similar functions as those described above for apparatus 10. A remote control, similar to remote control 52 described above, may be provided in wireless communication with controller and circuit 24 of apparatus 110 to allow an operator to remotely control the operation of apparatus 110, such as from the inside of the cab of the vehicle 112. The snow plow apparatus 110 includes a plurality of support elements in the form of jack stands 22 that function as described previously with apparatus 10, to support the apparatus 110 when it is detached from the vehicle 112. The snow plow apparatus 110 also includes a shock absorber or accumulator 25, which performs substantially the same function as the accumulators 25 of apparatus 10, to protect the apparatus 110 and/or vehicle 112 from damage due to impact events with heavy or immovable objects.

The snow plow apparatus 110 includes float and/or float-pivot functionalities of the plow wing 114 similar to those for plow wings 14*a*, 14*b* of apparatus 10 described above. In the illustrated embodiment of FIGS. 13-21, the float and float-pivot functionalities for apparatus 110 are accomplished with a float apparatus that may optionally cooperate with the powered actuator 140 to allow the plow wing 114 to float and/or float-pivot similar to that described with apparatus 10 above. The float apparatus of the illustrated embodiment of FIGS. 13-21 includes a float or toggle linkage assembly 144 coupled between the sweep pivot 120 and the proximal end 114*a* of the plow wing 114. The float linkage assembly 144 allows the plow wing 114 to somewhat freely float or move parallel to the sweep axis defined by the sweep pivot 120 while defining a maximum alignment offset or float positioning between the pivot arm 122 and the plow wing 114. The alignment offset or float positioning between the pivot arm 122 and the plow wing 114 is defined as the distance between centerlines of the pivot arm 122 and the plow wing 114. For example, in FIGS. 16A and 16C, the respective centerlines of the pivot arm 122 and the plow wing 114 are shown with dashed lines to illustrate the alignment offsets that are available as compared to the non-offset or neutral position of FIG. 16B.

The dashed centerlines in FIGS. 16A-16C illustrate the relative movement available to the plow wing 114 relative to the pivot arm 122 due to the float functionality that allows the plow wing 114 to move or offset relative to the pivot arm 122 and sweep pivot 120. As illustrated and described herein in relative terms, in FIG. 16A the centerline of the plow wing 114 is offset above the centerline of the pivot arm 122, in FIG. 16B the centerlines of the plow wing 114 and pivot arm 122 are substantially aligned, and in FIG. 16C the centerline of the plow wing 114 is offset below the centerline of the pivot arm 122. The float assembly 144 is configured such that the plow wing 114 remains substantially parallel to the pivot arm 122 at all times regardless of the relative centerline offset. While the float assembly 144 enables the plow wing 114 to move parallel to the sweep axis, the plow wing 114 is otherwise is rotationally fixed relative to the sweep pivot 120 via the float assembly 144. The float apparatus is configured such that the inboard end of the plow wing 114 is moveable an equal distance as the outboard end of the corresponding plow wing 114 in relation to the sweep pivot 120 or upright sweep axis. In other words, the inboard and outboard end of the plow wing 114 may raise and lower at substantially equal rates parallel and relative to the sweep pivot 120. Thus, the inboard and outboard ends of the plow wing 114 may raise and lower at substantially equal rates parallel and relative to the surface to be plowed, at least somewhat independently of the position of the longitudinal pivot arm 122.

Figure 19A:
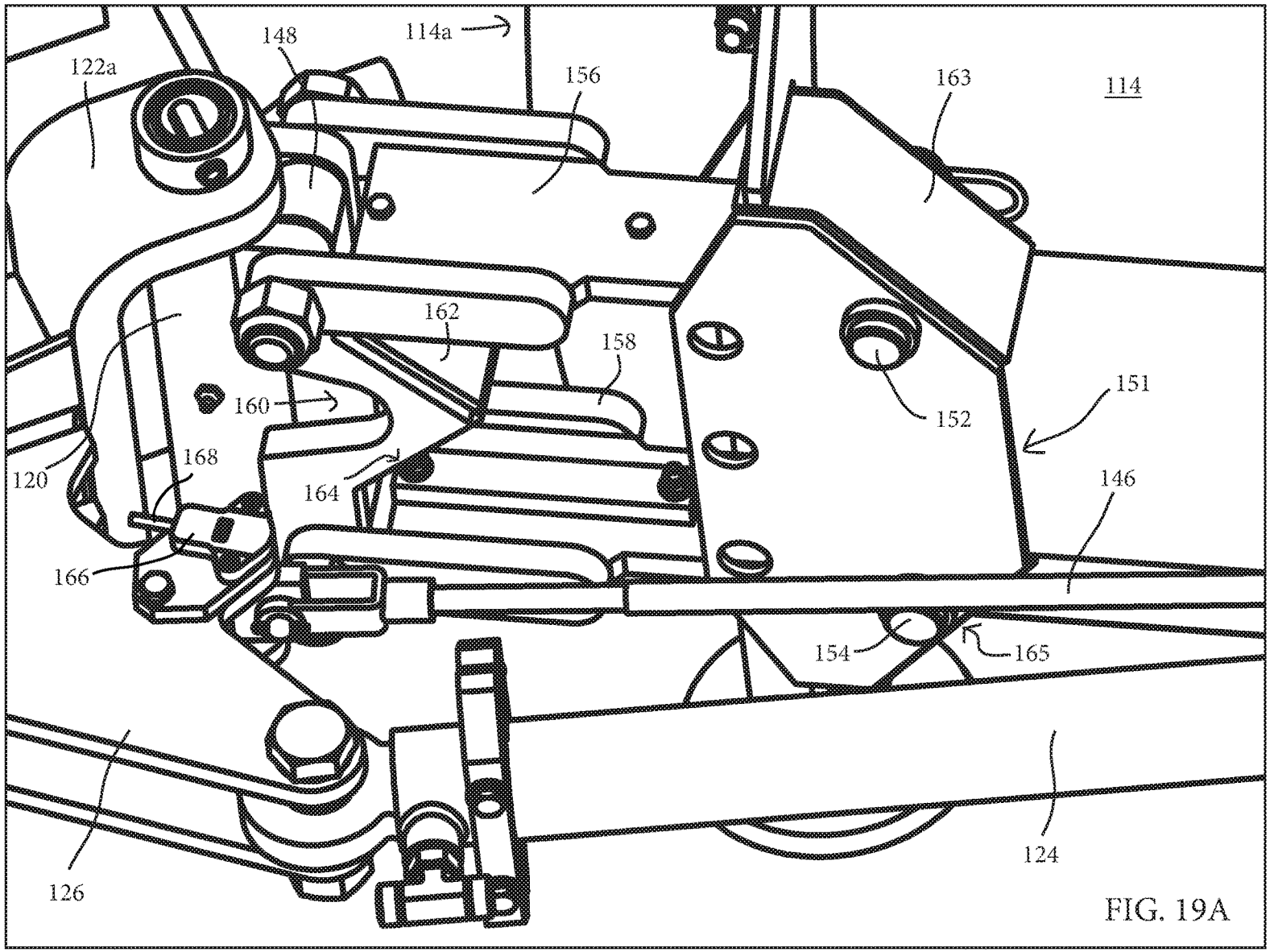
FIG. 19A is an enlarged view of the region designated XIX in FIG. 19.

The float assembly 144 is coupled to the sweep pivot 120 at respective upper and lower hinge pins 148 and 150 (pin 150 best shown in FIG. 20) and coupled at the opposite side to a receiver bracket 151 disposed on the proximal end 114*a* of plow wing 114 at respective upper and lower hinge pins 152 and 154 (FIG. 19A). The terms "upper" and "lower", as used with respect to the float assembly 144, are defined relative to the deployed configuration outboard of the right side of the vehicle 112 when viewed from the rear of the vehicle 112 as depicted in FIG. 13. The hinge pins 148, 150, 152, and 154 (FIGS. 19 and 19A) each define a pivot axis that is perpendicular to the sweep axis and substantially horizontal when the plow wing 114 is in the deployed configurations (at either the right or left side of vehicle). For example, the hinge pins 148, 150, 152, and 154 are substantially parallel to the vehicle's longitudinal axis when the plow wing 114 is in the deployed configuration and the neutral sweep position. The float assembly 144 includes an upper linkage arm 156, a lower linkage arm 158, and a float limiting member or stop block 160 that defines maximum float limits or offset distances at which the plow wing 114 can move, float, or offset relative to the sweep pivot 120 and pivot arm 122 (FIGS. 19 and 19A). The upper linkage arm 156 is pivotably coupled at one end to upper hinge pin 148 and at an opposite end to upper hinge pin 152. The lower linkage arm 158 is pivotably coupled at one end to lower hinge pin 150 and at an opposite end to lower hinge pin 154 (FIG. 20). The linkage arms 156 and 158 are substantially equal in length and as such maintain the plow wing 114 in a consistent orientation relative to the pivot arm 122 and sweep pivot 120, i.e. the centerline of the plow wing 114 remains substantially parallel to the centerline of the pivot arm 122 regardless of the offset between the centerlines.

The stop block 160 is disposed between upper hinge pin 148 and lower hinge pin 150 and includes an upper angled or ramped surface 162 and a lower angled or ramped surface 164 disposed opposite the upper surface 162 (FIGS. 19-20). The upper arm 156 and lower arm 158 are configured to contact the upper 162 and lower 164 ramped surfaces respectively when the plow wing 114 is actuated between configurations to stop and limit the movement of the plow wing 114 relative to the sweep pivot 120. The receiver bracket 151 also includes an upper angled or ramped surface 163 (FIG. 19) and a lower angled or ramped surface 165 (FIG. 20) that are configured to limit the movement of the upper and lower linkage arms 156, 158 when the plow wing 114 is actuated between configurations to stop and limit the movement of the plow wing 114 relative to the sweep pivot 120. For example, as the pivot arm 122 rotates as shown between FIGS. 16C and 16D, the upper linkage arm 156 will lower until it contacts the upper surface 162 of the stop block 160 and contacts the upper surface 163 of the receiver bracket 151 at which point the arm 156 is then stopped from further movement. As the pivot arm 122 continues to rotate, the plow wing 114 eventually lifts off the plowed surface because the float assembly 144 has reached a maximum float position (FIG. 16D). Depending on the configuration of the plow wing 114 relative to the sweep pivot 120, the upper linkage arm 156 and lower linkage arm 158 are either in tension or compression. When the plow wing 114 is in the configuration shown in FIG. 16B the upper arm 156 is in tension and the lower arm 158 is in compression, whereas when the plow wing 114 is in or near the fully upright configuration, similar to that shown in FIG. 16E, both arms 156 and 158 may be in compression, and whereas when the plow wing 114 is in the configuration shown in FIG. 16G, the linkage arm 156 is in compression and linkage arm 158 is in tension. As the plow wing 114 is lowered from the upright configuration shown in FIG. 16E toward the plowed surface on either side of the vehicle 112, the float position of the plow wing 114 shifts as gravity forces the plow wing downward, such as in the manner illustrated between FIGS. 16F and 16G. As such, the tension/compression forces in the respective linkage arms 156 and 158 change according to support the weight of the plow wing 114 as it becomes further cantilevered outboard from the sweep pivot 120.

The following provides an illustrative description of the relative movements of the plow apparatus 110 in reference to the sequence of raising the plow wing 114 shown in FIGS. 16A-16D due to the cantilevered nature of the plow wing 114 in the deployed configuration. As the pivot arm 122 begins to rotate counter-clockwise about the longitudinal axis the upper linkage arm 156 moves upward from the plowed surface and partially inboard toward the centerline of the vehicle 112 while the lower linkage arm 158 moves primarily upward. Due to the partially inboard movement of the upper linkage arm 156, the upper portion of the plow wing 114 is also pulled inboard while the lower arm 158 pushes toward the lower portion of the plow wing 114, causing the distal end 114*b* of the plow wing 114 to lift off of the plowed surface while the proximal end 114*a* remains in contact with the plowed surface (FIG. 16C). As the pivot arm 122 continues to rotate counter-clockwise, the upper linkage arm 156 is moved upward and further inboard while the lower arm 158 moves upward and begins to move partially inboard until the upper linkage arm 156 contacts the upper surface 162 of stop block 160 and upper surface 163 of receiver bracket 151, limiting further float movement of the plow wing 114 relative to the sweep pivot 120. From here, the plow wing 114 begins to raise away from the plowed surface (FIG. 16D) and the center of gravity (CG) of the plow wing 114 continues to move toward the centerline of the vehicle until the CG is substantially above the sweep pivot 112. The float assembly 144 retains its configuration until the plow wing 114 is rotated to the opposite side of the vehicle 112 (FIG. 16F) and the CG moves to the opposite outboard side of the sweep pivot 120, at which point the float assembly 144 shifts and the linkage arms 156 and 158 shift until linkage arm 158 contacts surface 164 of the stop 160 and surface 165 of bracket 151 (FIG. 16G).

Figure 22:
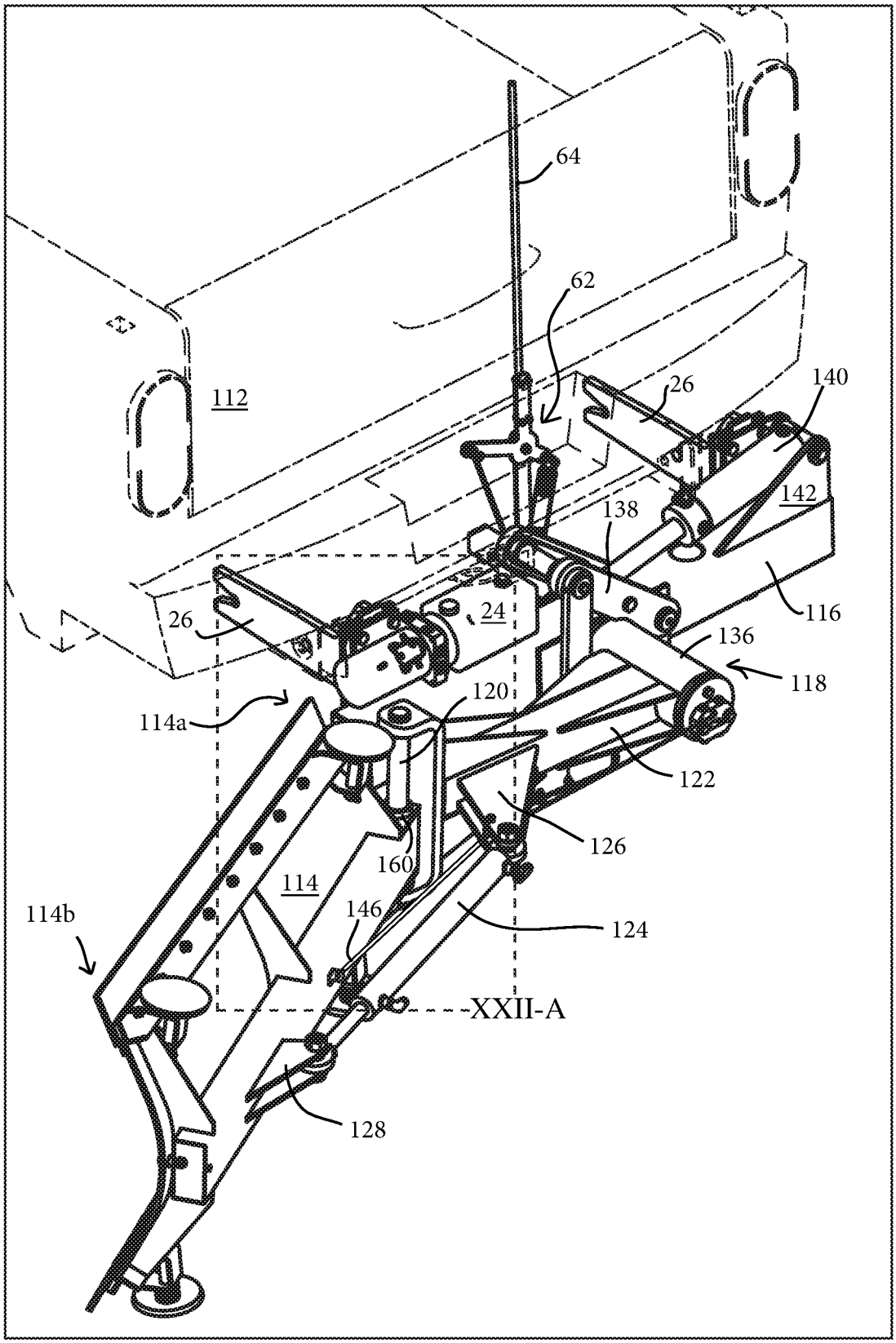
FIG. 22 is a rear perspective view of another vehicle mounted wing plow system in accordance with the present invention, with single plow wing deployed outboard of the left side of the vehicle.
Figure 22A:
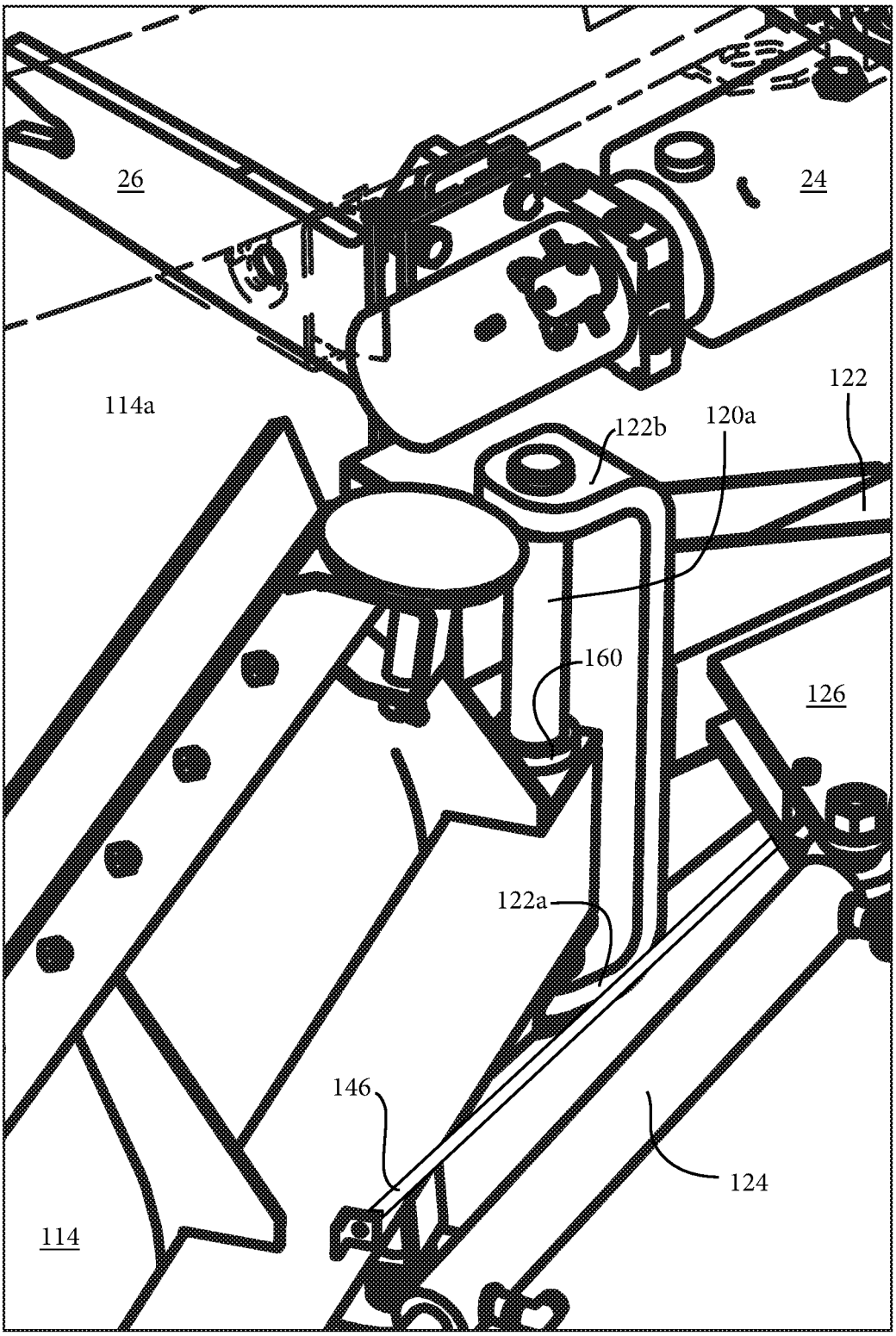
FIG. 22A is an enlarged view of the region designated 22A in FIG. 22.

Optionally, as shown in FIGS. 22 and 22A, the float functionality of apparatus 110 may be accomplished with a float apparatus which functions in a similar fashion to that described with apparatus 10 above. In the optional embodiment of FIGS. 22 and 22*a*, a float sleeve 160 is fixed to the proximal end 114*a* of the wing 114 and is rotatably and slideably disposed around sweep pivot 120*a* which is fixed between spaced-apart plates 122*a* and 122*b* at the distal end of pivot arm 122. A notable difference between sweep pivot 120 and sweep pivot 120*a* is that sweep pivot 120*a* is rotationally fixed to the plates 122*a* and 122*b*, as best shown in FIG. 22A. The float sleeve 160 is rotatable around sweep pivot 120*a* enabling the plow wing 114 to pivot about the sweep axis. The float sleeve 160 is also slidable along the sweep pivot 120*a* between the plates 122*a* and 122*b*, enabling the plow wing 114 to float or adjust to vertical inconsistencies in the surface to be plowed, in a similar fashion described for apparatus 10 above.

Figure 17A:
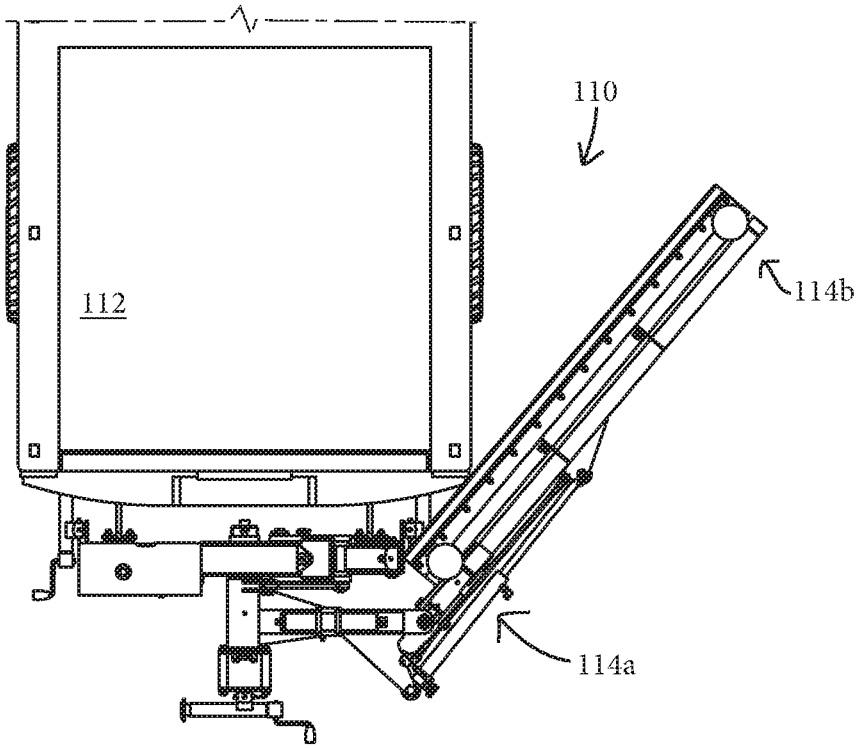
FIG. 17A-17D are top plan views of the system of FIG. 13, depicting sequential steps of moving the plow wings from a partially forward-swept configuration to a fully rearward-swept configuration.
Figure 17B:
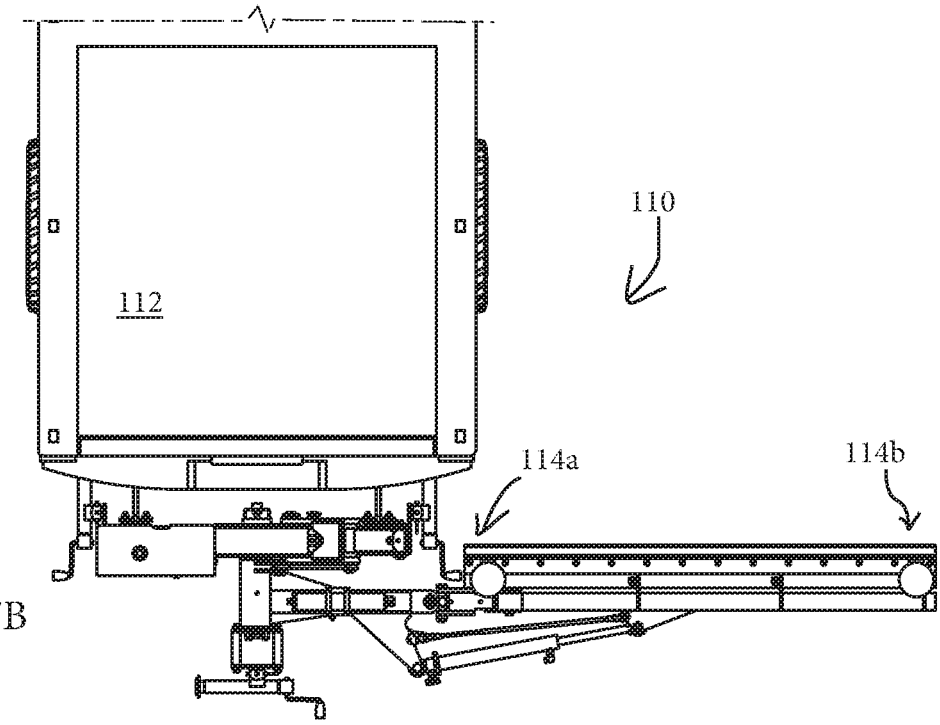
Figure 17C:
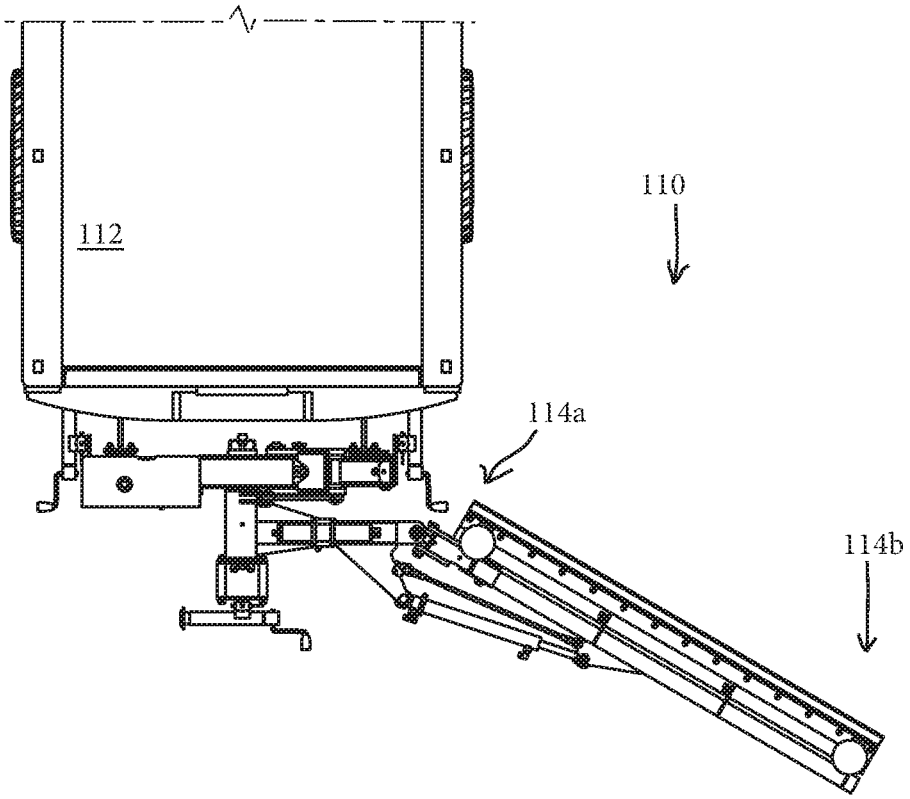
Figure 17D:
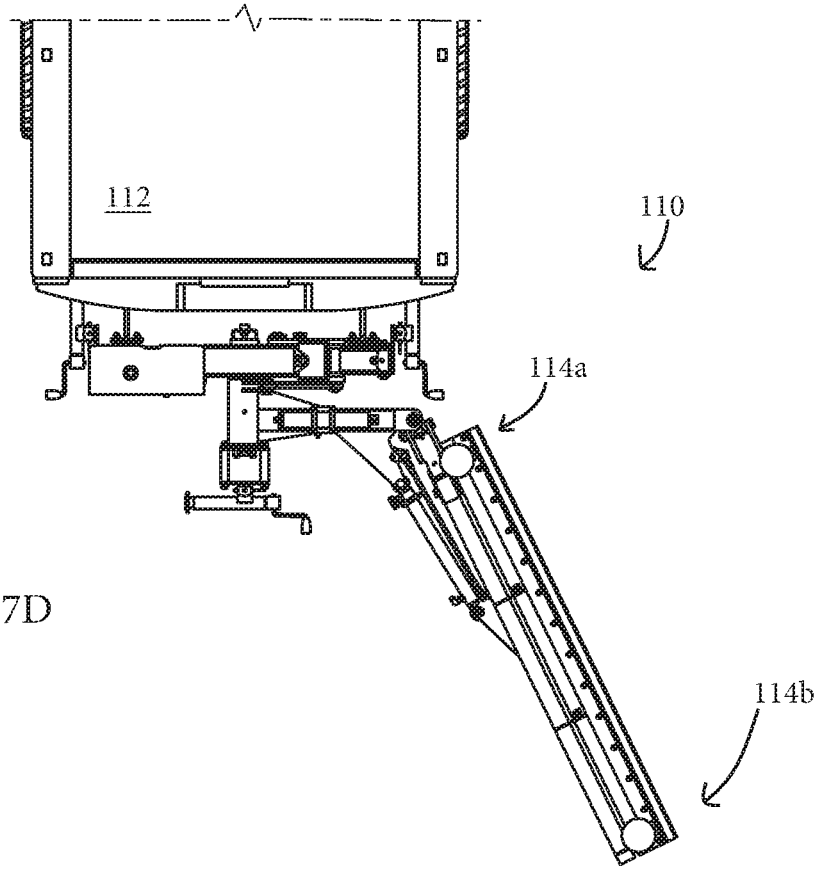
Figure 18:
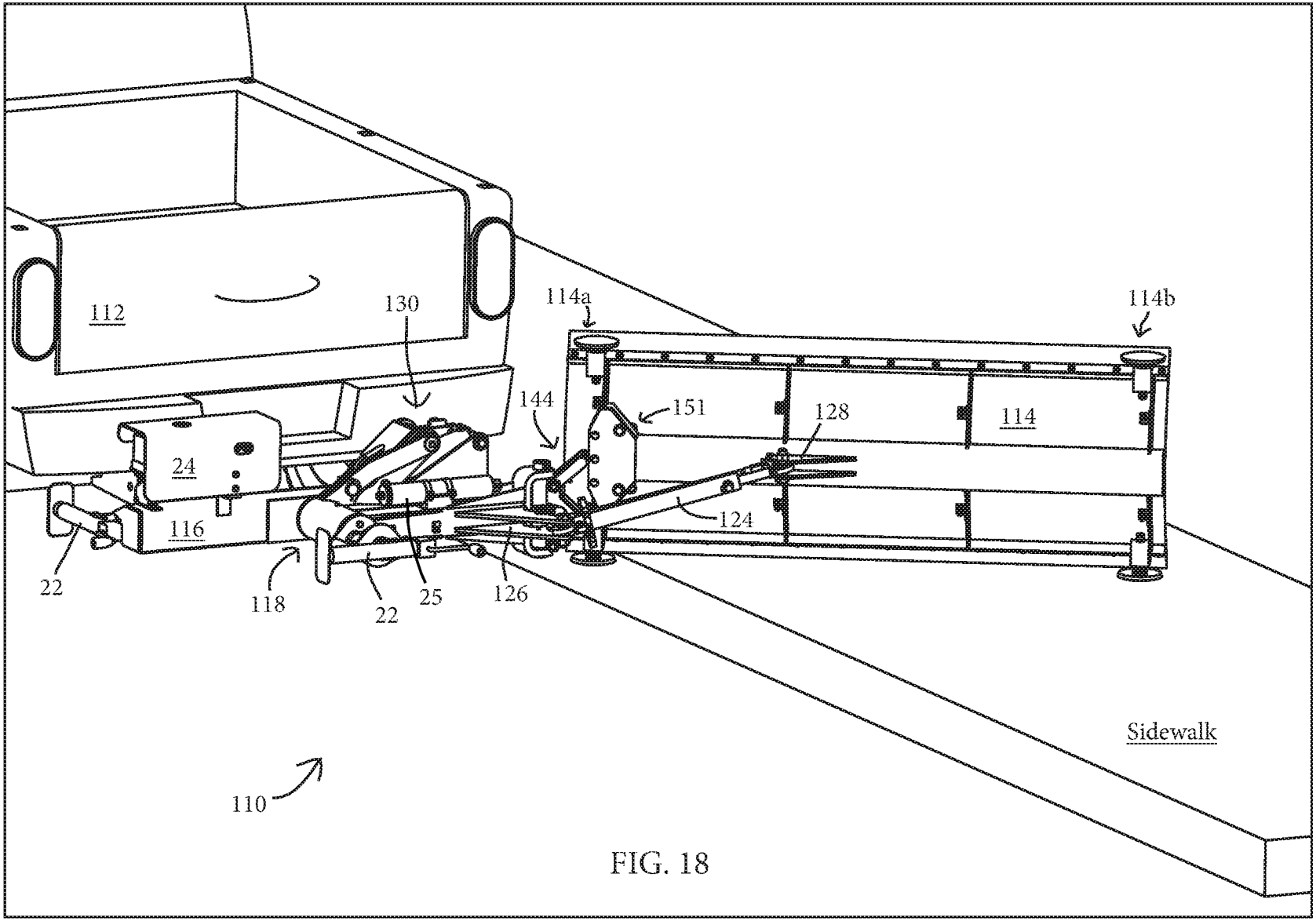
FIG. 18 is a rear perspective view of the vehicle mounted wing plow system of FIG. 13, depicted with the single plow wing in a float configuration.

A passive or analog plate position indicator 62 may be provided with snow plow apparatus 110, as shown in FIG. 22. The analog indicator 62 may be provided alone or in combination with an electronic plate position sensor, such as electronic sensor 20 of apparatus 10. The indicator 62 includes a movable indicator arm 64 that is visible to an operator occupying the cab of the vehicle 112, such as over the top of a truck tailgate, either by looking backward or by viewing through a rearview mirror. The indicator 62 is coupled to a component of the snow plow apparatus 110, such as the sweep actuator 124, or the deployment actuation mechanism 130. As such, the indicator 62 moves or changes positions as a function of the position of the plow wing 114. Thus, as the respective component actuates or moves, the indicator 62 also moves. For example, if the plow wing 114 is fully rearward-swept, such as shown in FIG. 17D, the indicator arm 64 may be visibly tilted to one side of the vehicle and once the plow wing 114 is positioned in a preferred position, such as the normal operation position shown in FIG. 17C which is about 30° rearward of the neutral position, the indicator arm 64 is vertical as shown in FIG. 22, indicating to an operator that the plow wing 114 is in the preferred position. The analog indicator 62 may also be provided with snow plow apparatus 10.

Figure 15:
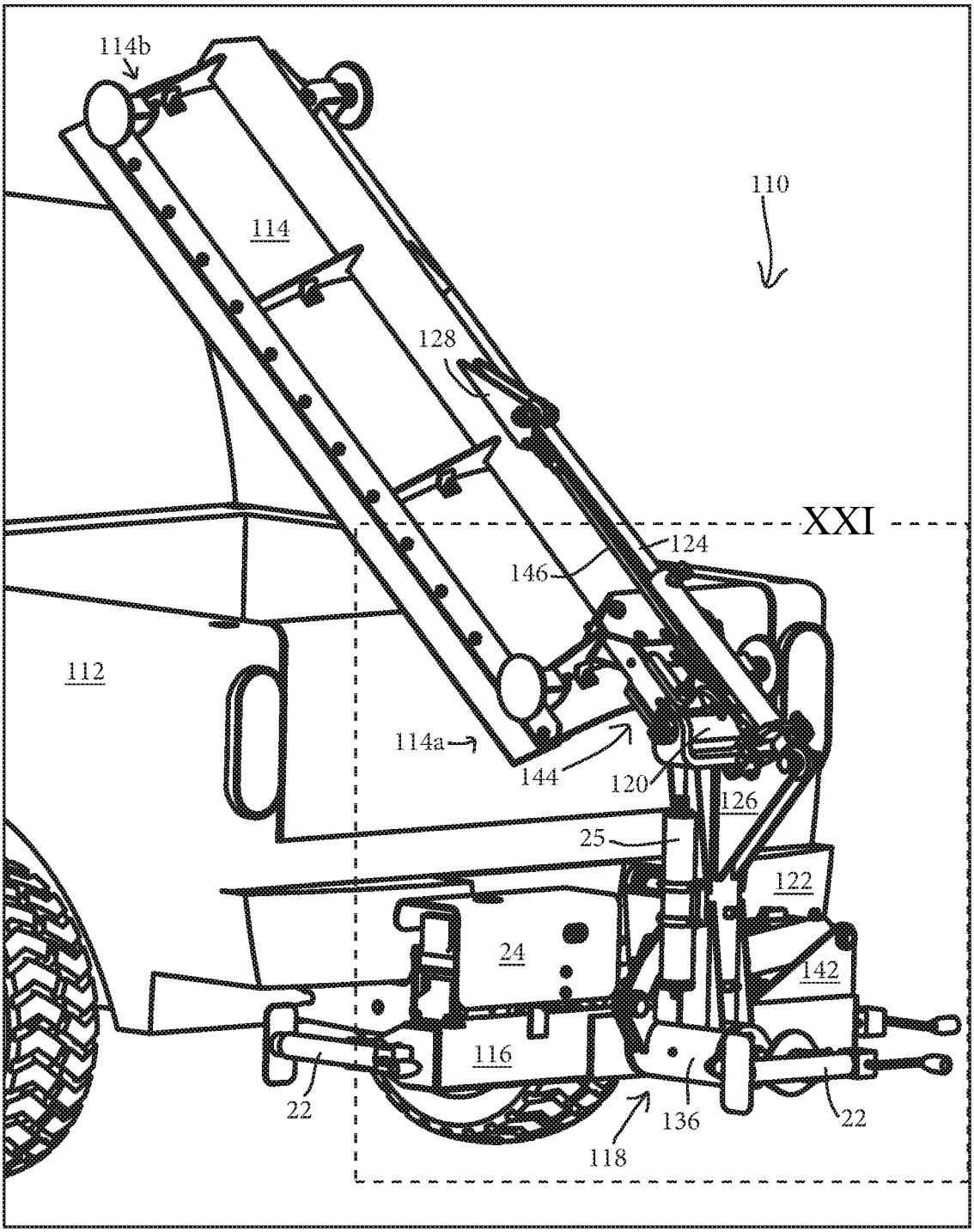
FIG. 15 is a rear perspective view of the vehicle mounted wing plow system of FIG. 13, with single plow wing stowed behind the vehicle.

Optionally, and as shown in the illustrated embodiments of FIGS. 19, 19A, 22, and 22A, a linkage arm 146 is provided to communicate the plow wing 114 sweep position to the indicator 62. The linkage arm 146 is coupled between the pivot bracket 126 and a portion of the plow wing 114, such as a center portion of plow wing 114 (FIGS. 22 and 22A) or at the actuation bracket 128 (FIG. 15). The linkage arm 146 may communicate with the indicator 62 in an analog manner, such as via a linkage assembly (not shown) coupled between linkage arm 146 and the indicator 62, or may communicate with the indicator 62 or an in-vehicle display (not shown) in an electronic manner via a rotary sensor 166 as shown in FIGS. 19 and 19A. The rotary sensor 166 is coupled to the pivot bracket 126, and receives a shaft (now shown) that passes through the pivot bracket 126 and is coupled to the linkage arm 146. As the plow wing 114 moves between sweep positions, the plow wing 114 causes the linkage arm 146 to move relative to the pivot bracket 126, and causes the shaft to rotate relative to the rotary sensor 166. The sensor 166 detects movement of the shaft, and therefore of the linkage arm 146 and the plow wing 114 as the plow wing pivots through its sweep arc, and generates an electronic signal that is indicative of the plow wing's sweep position, which is output to the indicator 62 (or to an in-vehicle display) through a communications wire 168. The indicator 62 includes a two-way actuator for adjusting the position of the indicator arm 64 accordingly based on the position of the rotary sensor 166, or can output a signal to an in-vehicle display, to indicate to the operator the sweep position of the plow wing 114. In order to accommodate pivoting movement of the plow wing about the deployment axis, the linkage arm 146 is coupled to the actuation bracket 128 via a two-axis pivot coupling, and is coupled to the sensor shaft (at rotary sensor 166 and pivot frame 126) by a single-axis pivot coupling, although it will be appreciated that the sensor shaft also rotates about its own axis, so that the linkage arm 146 is essentially coupled to the pivot frame 126 by a two-axis coupling that includes the sensor shaft that is sensed by the rotary sensor 166.

Optionally, the movement of the linkage arm 146 causes a switch and switch pin (generally corresponding to the rotary sensor 166 and wire 168) to rotate relative to the pivot frame 126 and the pivot arm 122. When the switch is rotated toward the pivot arm 122, the switch pin moves toward the pivot arm 122 until it contacts the pivot arm 122. As the switch continues to rotate toward the pivot arm 122, the switch pin is pushed or retracted into the switch. As the plow wing 114 is moved toward the opposite sweep position, the switch pin extends toward the pivot arm until it is no longer in contact with the pivot arm 168. The extension and retraction of the switch pin 168 into and out of the switch toggles the switch and the toggling of the switch is electronically communicated to the indicator 62 (or an in-vehicle display) to communicate the sweep position of the plow wing 114, depending on what position the plow wing 114 occupies.

Accordingly, the snow plow apparatus of the present invention provides a pivotable plowing element or plate coupled with a vehicle for plowing snow, wherein the plowing plate is deployable from a stowed configuration substantially behind the vehicle without extending laterally beyond the width of the vehicle sides to a deployed configuration in which the wing plate extends beyond one or more of the sides of the vehicle to plow snow or debris adjacent to the footprint of the vehicle. The snow plow apparatus may include a single pivotable plow plate for selective deployment to each side of the vehicle or may include two pivotable plow plates each selectively and independently deployable to a respective side of the vehicle. An optional center blade flips or folds down to plow snow or debris that is directly behind the footprint of the vehicle. Each wing plate is operable to pivot about a longitudinal axis that is substantially parallel to the direction of travel of the vehicle and operable to further pivot about a sweep axis that is perpendicular to the longitudinal axis. The snow plow apparatus includes powered actuators and an electronic controller to control the actuators to deploy, stow, and position the plates of the snow plow apparatus. The snow plow apparatus includes plate position indicators configured to indicate a position of the apparatus to an operator of the apparatus, such as to sense and communicate the position of the plates in various sweep positions. Accumulators are disposed with each plate to allow the plate to break away after an impact with an immovable or unexpectedly heavy object such that damage to the snow plow apparatus and vehicle is minimized or eliminated due to such impacts. The accumulators may return the plates to the position that they occupied prior to an impact. Jack stands are provided with the snow plow apparatus to aid in coupling the apparatus to a vehicle and for removal and storage of the apparatus when it is not coupled to a vehicle.

Changes and modifications in the specifically described embodiments can be carried out without departing from the principles of the present invention, which is intended to be limited only by the scope of the appended claims, as interpreted according to the principles of patent law, including the doctrine of equivalents.

The embodiments of the invention in which an exclusive property is claimed are defined as follows:

1. A snow plow apparatus for use with a vehicle, said snow plow apparatus comprising:

a support frame;

a snow pushing plate having an inboard end coupled to said support frame and a free outboard end opposite said inboard end, wherein said plate is pivotably deployable and retractable about a deployment pivot, and said plate is further pivotable about an upright sweep axis when in a deployed configuration;

a vehicle mount configured to secure said support frame to the vehicle; and a single powered deployment actuator coupled between said plate and said support frame for deploying and stowing said plate about said deployment pivot;

wherein said plate contacts a surface to be plowed when in said deployed configuration, and said plate is pivotable to a stowed configuration in which at least a portion of said plate is above said support frame.

2. The snow plow apparatus of claim 1, wherein said plate, while in said deployed configuration, is pivotable between a forward-swept position in which said outboard end of said plate is forward of said inboard end relative to the forward direction of travel and a fully rearward-swept position in which said plate is positioned at least 60° rearward of perpendicular with respect to the forward direction of travel, and with said outboard end rearward of said inboard end relative to the forward direction of travel, and said plate is selectively positionable incrementally between said forward-swept position and said fully rearward-swept position.

3. The snow plow apparatus of claim 1, wherein said mount comprises at least one chosen from a hitch receiver connection configured to be inserted into a vehicle hitch receiver and a vehicle frame engaging support configured to engage the frame of the vehicle at a location other than the hitch receiver.

4. The snow plow apparatus of claim 1, further comprising a float apparatus enabling said plate to vertically raise and lower relative to said support frame, such that said plate automatically moves in response to changes in the height of the surface to be plowed relative to said support frame.

5. The snow plow apparatus of claim 1, further comprising an accumulator coupled to said plate and configured such that said accumulator permits said plate to swing away from an object impacted by the plate to protect said snow plow apparatus from damage, and wherein said accumulator is operable to return said plate to a pre-impact configuration or position.

6. The snow plow apparatus of claim 1, further comprising a center snow pushing plate configured to remove debris or snow located on a surface directly below said support frame, wherein said center plate is pivotably coupled to a lower portion of said support frame such that said center plate is moveable from a stowed configuration in which said center plate is above the surface to be plowed, to a deployed configuration in which said center plate is in contact with the surface to be plowed.

7. The snow plow apparatus of claim 6, further comprising an impact relief actuator coupled to said center plate and configured such that said center plate moves away from an object and then returns to said deployed configuration as a result of an impact event with an object, to protect said snow plow apparatus and the vehicle from damage.

8. The snow plow apparatus of claim 1, further comprising powered sweep actuator coupled to said plate and configured to pivot said plate about the sweep axis.

9. The snow plow apparatus of claim 8, further comprising an electronic controller that is selectively operable to control said powered deployment actuator and said powered sweep actuator.

10. The snow plow apparatus of claim 9, further comprising a remote controller in wireless communication with said electronic controller.

11. The snow plow apparatus of claim 1, further comprising a blade location indicator that is operable to communicate at least one chosen from location, position, and orientation of said pivotably deployable snow pushing plate to an operator of said snow plow apparatus.

12. The snow plow apparatus of claim 1, wherein said plate is selectively operable to deploy to one outboard side of the vehicle and to an opposite outboard side of the vehicle.

13. The snow plow apparatus of claim 1, further comprising another pivotably deployable snow pushing plate pivotably coupled to said support frame, wherein said another plate is selectively operable to deploy to one outboard side of the vehicle opposite said plate.

14. A snow plow apparatus for use with a vehicle to clear snow or debris from a surface to be plowed adjacent to the vehicle, said snow plow apparatus comprising:

a support frame removably coupled to a vehicle;

a pivotably deployable snow pushing plate having an inboard end pivotably coupled to said support frame and a free opposite end extending outwardly from said inboard end, wherein said plate is pivotable about a horizontal deployment axis;

a powered deployment actuator coupled to said plate and selectively operable to automatically stow and deploy said plate between a stowed configuration in which at least a portion of said plate is above said support frame and occupies a space behind the vehicle, and a deployed configuration in which said plate is in contact with a surface to be plowed and extends laterally outwardly from the vehicle; and a float apparatus enabling said plate to vertically raise and lower relative to the support frame, such that said plate automatically moves in response to changes in the height of the surface to be plowed relative to said support frame;

wherein said plate is pivotable around an upright sweep axis when said plate is in the deployed configuration, such that said plate, while in the deployed configuration, is selectively positionable at a plurality of sweep positions by pivoting said plate about the sweep axis; and wherein said float apparatus is configured such that said plate is enabled to vertically raise and lower parallel to the upright sweep axis and such that an inboard end of said plate is moveable an equal vertical distance as an outboard end of said plate when said plate is in the deployed configuration.

15. The snow plow apparatus of claim 14, wherein said float apparatus comprises a linkage assembly coupled between said plate and said support frame and a float-limiting member configured to limit the movement of said linkage assembly such that said float-limiting member defines minimum and maximum heights of said plate relative to said support frame when in the deployed configuration.

16. The snow plow apparatus of claim 15, wherein said linkage assembly comprises a pair of spaced-apart linkage arms, each of said linkage arms pivotably coupled at one end to said support frame and at an opposite end to said plate, and wherein said float-limiting member is disposed between said linkage arms and contacted by one of said linkage arms at each of the minimum and maximum heights.

17. A snow plow apparatus for use with a vehicle, said snow plow apparatus comprising:

a pivotably deployable plate configured to clear snow or debris from a surface to be plowed that is outboard of the drive path of the vehicle when said plate is in a deployed configuration;

a deployment actuation mechanism coupled between the vehicle and said plate, wherein said deployment actuation mechanism is selectively operable to move said plate around a longitudinal axis that is parallel to the forward direction of travel of the vehicle between a stowed configuration in which said plate is above the surface to be plowed and directly behind the vehicle, and the deployed configuration in which said plate is in contact with the surface to be plowed and outboard of the drive path of the vehicle;

a sweep actuation mechanism coupled to said plate that is selectively operable to move said plate around a sweep axis that is perpendicular to said longitudinal axis and vertical when said plate is in the deployed configuration, such that said plate is operable to move parallel to the surface to be plowed when said plate is in the deployed configuration; and a float apparatus configured to permit an inboard end and an outboard end of said plate to vertically raise and lower automatically relative to the surface to be plowed in response to changes in the height of the surface to be plowed relative to the vehicle;

wherein said float apparatus is configured such that said inboard end and said outboard end of said plate are moveable equal vertical distances as one another relative to the surface to be plowed when said plate is in the deployed configuration; and wherein said deployment actuation mechanism and said sweep actuation mechanism are selectively operable independent of one another.

18. The snow plow apparatus of claim 17, further comprising an electronic controller that is selectively operable to control a powered deployment actuator coupled to said deployment actuation mechanism and to control a powered sweep actuator coupled to said sweep actuation mechanism, wherein said powered actuator and said powered sweep actuator are each operable to automatically move a respective one of said deployment actuation mechanism and said sweep actuation mechanism.

19. The snow plow apparatus of claim 17, further comprising a support frame removably coupled to a vehicle, wherein said deployment actuation mechanism is coupled to said support frame, and wherein said float apparatus comprises a pair of linkage arms pivotably coupled between said plate and said support frame.

20. The snow plow apparatus of claim 17, wherein said plate is selectively operable to deploy to one outboard side of the vehicle and to an opposite outboard side of the vehicle.

* * * * *